US008577251B2

(12) United States Patent
Awano et al.

(10) Patent No.: US 8,577,251 B2
(45) Date of Patent: Nov. 5, 2013

(54) IMAGE FORMING APPARATUS COMPRISING A FRAME, AN INTERMEDIATE TRANSFER SECTION, AND A PLURALITY OF BUILT-IN-BODIES

(75) Inventors: Toyohiko Awano, Yokohama (JP); Shin Komatsu, Yokohama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 222 days.

(21) Appl. No.: 13/021,886

(22) Filed: Feb. 7, 2011

(65) Prior Publication Data

US 2012/0076531 A1 Mar. 29, 2012

(30) Foreign Application Priority Data

Sep. 24, 2010 (JP) ..... 2010-214034

(51) Int. Cl.
*G03G 15/00* (2006.01)
*G03G 21/16* (2006.01)

(52) U.S. Cl.
USPC ..... 399/107; 399/111; 399/117; 399/167

(58) Field of Classification Search
USPC ..... 399/107, 111, 167
See application file for complete search history.

(56) References Cited

U.S. PATENT DOCUMENTS

| | | | | |
|---|---|---|---|---|
| 7,542,702 | B2 * | 6/2009 | Saito et al. | 399/112 |
| 2002/0118989 | A1 * | 8/2002 | Tokutake et al. | 399/401 |
| 2004/0091283 | A1 * | 5/2004 | Nobe et al. | 399/110 |
| 2004/0101328 | A1 * | 5/2004 | Kimura et al. | 399/111 |
| 2005/0002690 | A1 * | 1/2005 | Park et al. | 399/117 |
| 2005/0008394 | A1 * | 1/2005 | Ishii et al. | 399/111 |
| 2005/0117934 | A1 * | 6/2005 | Murayama et al. | 399/111 |
| 2006/0198654 | A1 * | 9/2006 | Noda et al. | 399/90 |
| 2007/0147895 | A1 * | 6/2007 | Hayakawa | 399/167 |
| 2007/0177893 | A1 * | 8/2007 | Goda | 399/114 |
| 2007/0230988 | A1 * | 10/2007 | Nobe et al. | 399/88 |
| 2008/0003015 | A1 * | 1/2008 | Tomatsu | 399/110 |
| 2009/0285594 | A1 * | 11/2009 | Kichise et al. | 399/75 |
| 2011/0116831 | A1 * | 5/2011 | Honobe et al. | 399/110 |

FOREIGN PATENT DOCUMENTS

| | | |
|---|---|---|
| JP | 9-166898 | 6/1997 |
| JP | 2002-235838 | 8/2002 |
| JP | 2004-45923 | 2/2004 |
| JP | 2005-242082 | 9/2005 |
| JP | 2009031598 A * | 2/2009 |

OTHER PUBLICATIONS

Machine translation of JP 2009031598.*

* cited by examiner

*Primary Examiner* — Walter L Lindsa, Jr.
*Assistant Examiner* — David Bolduc
(74) *Attorney, Agent, or Firm* — Sughrue Mion, PLLC

(57) ABSTRACT

An image forming apparatus includes: a frame that includes a pair of standing walls spaced apart from each other, and a linking section linking the pair of standing walls; and an intermediate transfer section that includes support rolls extending between the pair of standing walls and supported by the pair of standing walls, and an intermediate transfer belt held by the support rolls and circulating. The apparatus further includes built-in bodies, at least, into each of which a photoreceptor roll having a shaft with protruding both ends and rotatable around the shaft is incorporated, and which are arranged along the intermediate transfer belt while being supported in a state that the both ends of the shaft penetrate the pair of standing walls, and each of which is fixed to a first standing wall of the pair of standing walls by a screw.

6 Claims, 18 Drawing Sheets

IMAGE FORMING APPARATUS COMPRISING A FRAME, AN INTERMEDIATE TRANSFER SECTION, AND A PLURALITY OF BUILT-IN-BODIES

CROSS-REFERENCE TO RELATED APPLICATION

This application is based on and claims priority under 35 USC 119 from Japanese Patent Application No. 2010-214034, filed Sep. 24, 2010.

BACKGROUND (i) Technical Field

The present invention relates to an image forming apparatus.

(ii) Related Art

There is known such a structure in an image forming apparatus that each predetermined photoreceptor drum and exposure device may be attached to each position in a housing swiftly and precisely.

Further, there is known an image forming apparatus in which a tapered part is formed at an end portion of a shaft, and a mounting hole of a rotation body also is formed to be in a tapered shape. In this image forming apparatus, the mounting hole and the tapered part are mated with each other and a screw is tightened so that an internal circumferential surface of the mounting hole and a circumferential surface of the tapered part are caused to contact each other by pressure, and the shaft and the rotation body are coupled and fixed together.

Furthermore, there is known such a structure that a writing unit that holds an exposure device is supported by a main-unit frame of a main unit of a copying machine, a front plate and a rear plate while facing each other are attached to a frame of the writing unit, and an imaging device is supported by these front plate and rear plate.

Moreover, there is known such a structure that in an image forming apparatus, operation in a mounting direction of a transfer belt unit and fixation of a photoreceptor to a fixed position are interlocked via a gear and an interlocking plate. In this image forming apparatus, the operation at the time of mounting the transfer belt unit causes a fixing force to fix the photoreceptor to the fixed location, so that when the photoreceptor may come off the fixed position, the photoreceptor is pressed and held by the transfer belt unit.

SUMMARY

According to an aspect of the invention, an image forming apparatus includes: a frame that includes a pair of standing walls spaced apart from each other, and a linking section linking the pair of standing walls with each other; and an intermediate transfer section that includes plural support rolls extending between the pair of standing walls and being supported by the pair of standing walls, and an intermediate transfer belt held by the plural support rolls and circulating. The image forming apparatus further includes plural built-in bodies, at least, into each of which a photoreceptor roll having a shaft with protruding both ends and rotatable around the shaft is incorporated, and which are arranged along the intermediate transfer belt while being supported in a state that the both ends of the shaft penetrate the pair of standing walls, and each of which is fixed by a screw to a first standing wall of the pair of standing walls.

BRIEF DESCRIPTION OF THE DRAWINGS

Exemplary embodiments of the present invention will be described in detail based on the following figures, wherein.

DETAILED DESCRIPTION

A color printer that is an exemplary embodiment of the image forming apparatus of the present invention will be described below with reference to the drawings.

[Entire Structure]

Figure 1:
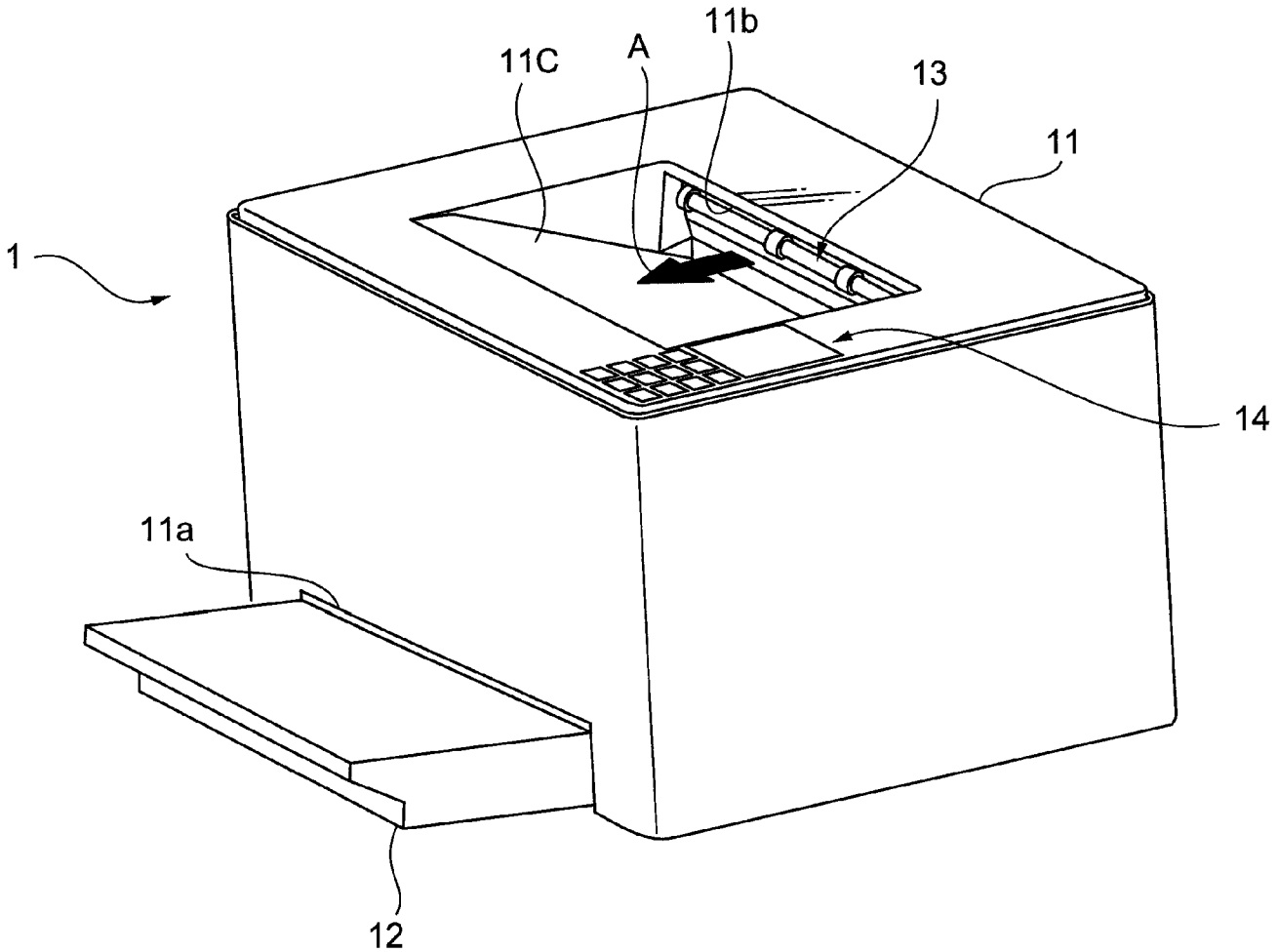
FIG. 1 is a perspective diagram that illustrates an appearance of the color printer that is the exemplary embodiment of the image forming apparatus of the present invention.

FIG. 1 is a perspective diagram that illustrates an appearance of the color printer that is the exemplary embodiment of the image forming apparatus of the present invention.

A color printer 1 is a printer that employs an intermediate transfer system, and an image forming unit, an intermediate transfer belt, which will be described later, and the like are housed in a housing 11 having a rectangular appearance.

On one of four sides of the housing 11, there is provided a mounting port 11*a* to which a paper tray 12 is detachably attached. The paper tray 12 where sheets of paper are housed is attached to this mounting port 11*a*, so that the sheets of paper are supplied to this color printer 1.

A depression is provided on a top surface of the housing 11, and on an inner-wall surface of the depression, there is provided a paper output port 11*b* from which a sheet of paper where an image is recorded is output. A pair of output rolls 13 to output the sheet of paper are attached in the inside of the paper output port 11*b*. The sheet of paper is sent out by these pair of output rolls 13 in an output direction indicated by an arrow A in FIG. 1, to be put on an output tray 11*c* that is the bottom of the depression. Incidentally, in FIG. 1, one of two rolls forming the pair of output rolls 13 is in sight.

Further, a control panel 14 to be operated by a user is provided on the top surface of this housing 11. The user operates this control panel 14, thereby giving various instructions including the number of sheets to be subjected to image formation, the scaling of images, and the like to this color printer 1.

Figure 2:
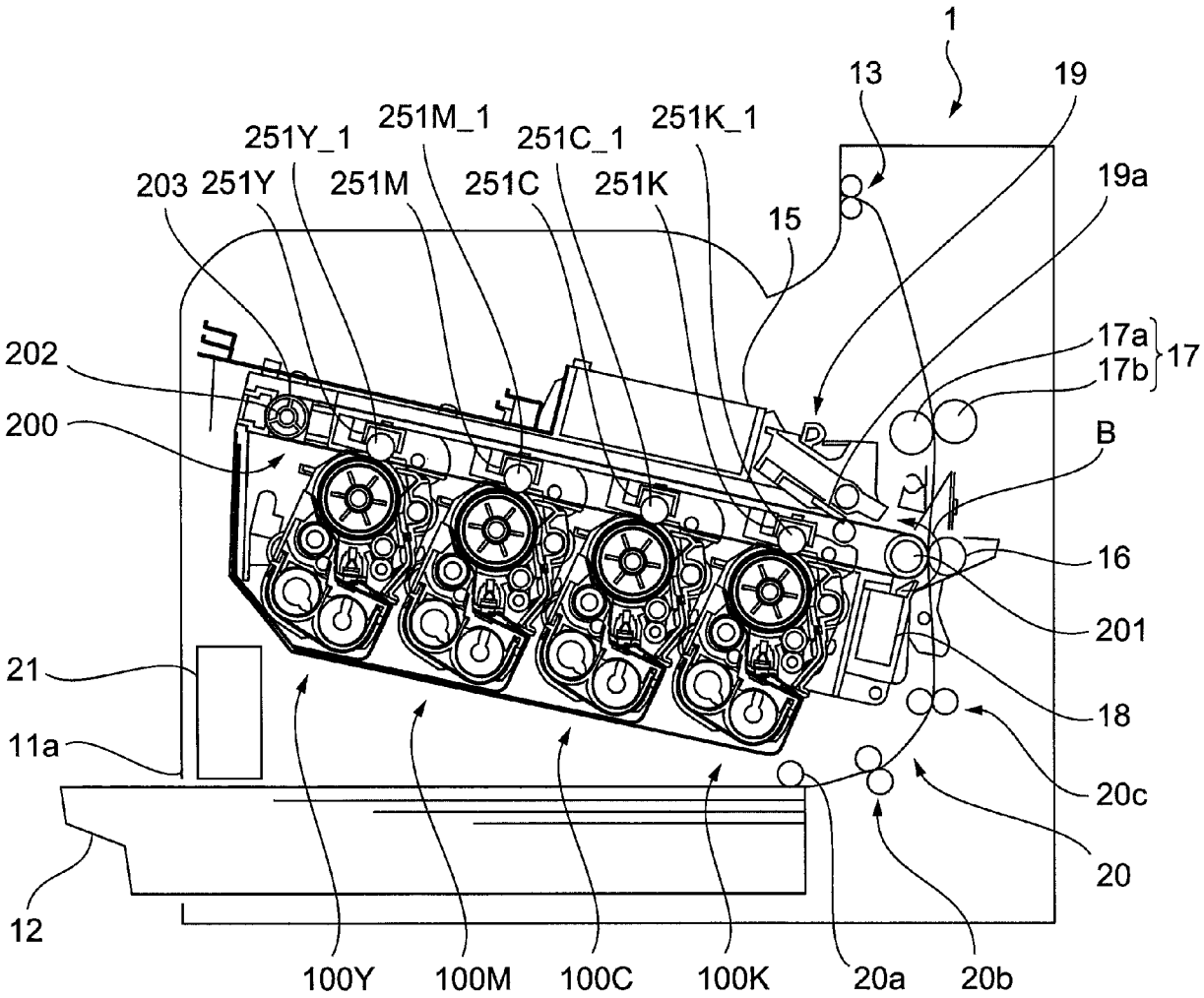
FIG. 2 is a cross-sectional diagram of the entire structure of the color printer illustrated in FIG. 1, taken along the sheet output direction of this color printer.

FIG. 2 is a cross-sectional diagram of the entire structure of the color printer illustrated in FIG. 1, taken along the sheet output direction of this color printer.

The color printer 1 includes four image forming units 100Y, 100M, 100C and 100K that form toner images of yellow (Y), magenta (M), cyan (C) and black (K) color components, respectively, by an electrophotography system. The color printer 1 further includes a belt transfer section 200 in which the color-component toner images formed by the image forming units 100Y, 100M, 100C and 100K are sequentially transferred (primary transfer) to an intermediate transfer belt 203. The color printer 1 further includes four primary transfer sections 251Y, 251M, 251C and 251K which transfer the toner images formed by the image forming units 100Y, 100M, 100C and 100K to the intermediate transfer belt 203.

The belt transfer section 200 includes a drive roll 201, a tension roll 202, and the intermediate transfer belt 203.

The drive roll 201 and the tension roll 202 extend between a pair of standing walls to be described later, and are supported by these pair of standing walls. The intermediate transfer belt 203 is held around the drive roll 201 and the tension roll 202. The drive roll 201 is rotationally driven by a not-illustrated motor, so that the intermediate transfer belt 203 circularly moves in a direction indicated by an arrow B.

This color printer 1 is a so-called tandem type of printer, and the four image forming units 100Y, 100M, 100C and 100K are disposed from the mounting port 11*a* side of the paper tray 12, namely, from an upstream side in the circularly moving of the intermediate transfer belt 203, along the intermediate transfer belt 203, in the order of Y, M, C and K. The four primary transfer sections 251Y, 251M, 251C and 251K are respectively disposed at positions facing photoreceptor rolls, which will be described later, of the respective four image forming units 100Y, 100M, 100C and 100K, one to one, with the intermediate transfer belt 203 interposed in between.

Here, in many of image forming apparatus mounted with photoreceptor rolls, the photoreceptor rolls are assumed to be replaced for, for example, maintenance and the like. In contrast, the color printer 1 illustrated in FIG. 1 and FIG. 2 is not based on the precondition that the photoreceptor rolls of the image forming units 100Y, 100M, 100C and 100K are to be replaced.

Further, the color printer 1 includes a power supply unit 15 that supplies electric power to each of internal components.

The primary transfer sections 251Y, 251M, 251C and 251K respectively have primary transfer rolls 251Y_1, 251M_1, 251C_1 and 251K_1 which face the photoreceptor rolls of the image forming units 100Y, 100M, 100C and 100K, across the intermediate transfer belt 203 interposed in between. Upon receipt of voltage application from the power supply unit 15, the primary transfer sections 251Y, 251M, 251C and 251K apply transfer bias voltages, each of which has a polarity opposite to a toner polarity, to the primary transfer rolls 251Y_1, 251M_1, 251C_1 and 251K_1 provided inside. By the primary transfer rolls 251Y_1, 251M_1, 251C_1 and 251K_1 to each of which this transfer bias voltage is applied, the color-component toner images formed in the image forming units 100Y, 100M, 100C and 100K are electrostatically attracted to the intermediate transfer belt 203 sequentially. As a result, the superimposed toner images are formed on the intermediate transfer belt 203.

Further, the color printer 1 includes a secondary transfer roll 16, a fuser 17, an image density sensor 18 and a belt cleaner 19.

The secondary transfer roll 16 is disposed at a position facing the drive roll 201 of the belt transfer section 200 across the intermediate transfer belt 203 in between, and the transfer bias voltage of the polarity opposite to the toner polarity is applied by the power supply unit 15 to the secondary transfer roll 16. Thus, to a sheet of paper arriving at a position between this secondary transfer roll 16 and the intermediate transfer belt 203 after passing through a paper conveyance path 20 to be described later, the color-component toner images sequentially transferred to the intermediate transfer belt 203 by the primary transfer are collectively transferred (secondary transfer).

The fuser 17 is disposed above the secondary transfer roll 16, and includes a heating roll 17*a* producing heat and a pressure roll 17*b* pressed against and thereby contacting this heating roll 17*a*. The sheet of paper to which each of the color-component toner images has been transferred by the secondary transfer roll 16 is heated and pressurized by a pressure contact part formed by the heating roll 17*a* and the pressure roll 17*b*. As a result, the toner images on the sheet of paper are fixed to this sheet of paper. The heating roll 17*a* and the pressure roll 17*b* are rotationally driven by a not-illustrated motor, and the sheet of paper is sent out toward the paper output port 11*b* illustrated in FIG. 1 while the toner images are fixed. Subsequently, the sheet of paper sent from this fuser 17 after the fixing is ejected by the pair of output rolls 13 that is illustrated also in FIG. 1.

The image density sensor 18 is disposed at a position downstream from the image forming unit 100K of black in the circularly moving direction of the intermediate transfer belt 203, and detects the density of the toner images on the intermediate transfer belt 203 at this position. The result of the detection by this image density sensor 18 is sent to a control section 21 to be described later, and used for image quality adjustment in the next and later image formation.

The belt cleaner 19 is disposed downstream from the secondary transfer roll 16 in the circularly moving direction of the intermediate transfer belt 203, and has a cleaning blade 19*a* whose tip abuts on the intermediate transfer belt 203. In the belt cleaner 19, residual toner, paper powder and the like are removed by this cleaning blade 19*a* from the intermediate transfer belt 203 after the secondary transfer.

Further, the color printer 1 includes the paper conveyance path 20 that conveys the sheets of paper in the paper tray 12 to a position (secondary transfer position) where the secondary transfer is performed by the secondary transfer roll 16.

In the paper conveyance path 20, a feed roll 20*a*, a pair of separation conveyance rolls 20*b* and a pair of resist rolls 20*c* are provided.

The feed roll 20*a* sends the sheets of paper from the paper tray 12. The pair of separation conveyance rolls 20*b* separately convey the sheets of paper sent by the feed roll 20*a*, one by one. The pair of resist rolls 20*c* forward the sheet of paper sent out by the pair of separation conveyance rolls 20*b*, to the secondary transfer position, being timed to the arrival of the toner images on the intermediate transfer belt 203 at the secondary transfer position.

The operation of each component described above is controlled by the control section 21. Further, in this control section 21, image data input through a not-illustrated connection cable from the outside of this color printer 1 is converted into coloring material tone data of four colors of Y, M, C and K. The coloring material tone data is then supplied to the image forming units 100Y, 100M, 100C and 100K. In addition, in the control section 21, at the time of the conversion into the coloring material tone data, the image quality adjustment based on the result of the detection by the image density sensor 18 is also performed.

[Image Forming Unit]

Next, the image forming unit will be described.

The image forming units 100Y, 100M, 100C and 100K have structures similar to each other except that the colors of the toners in use are different. The image forming units will be described below by using the image forming unit 100Y provided with reference characters as a representative.

Figure 3:
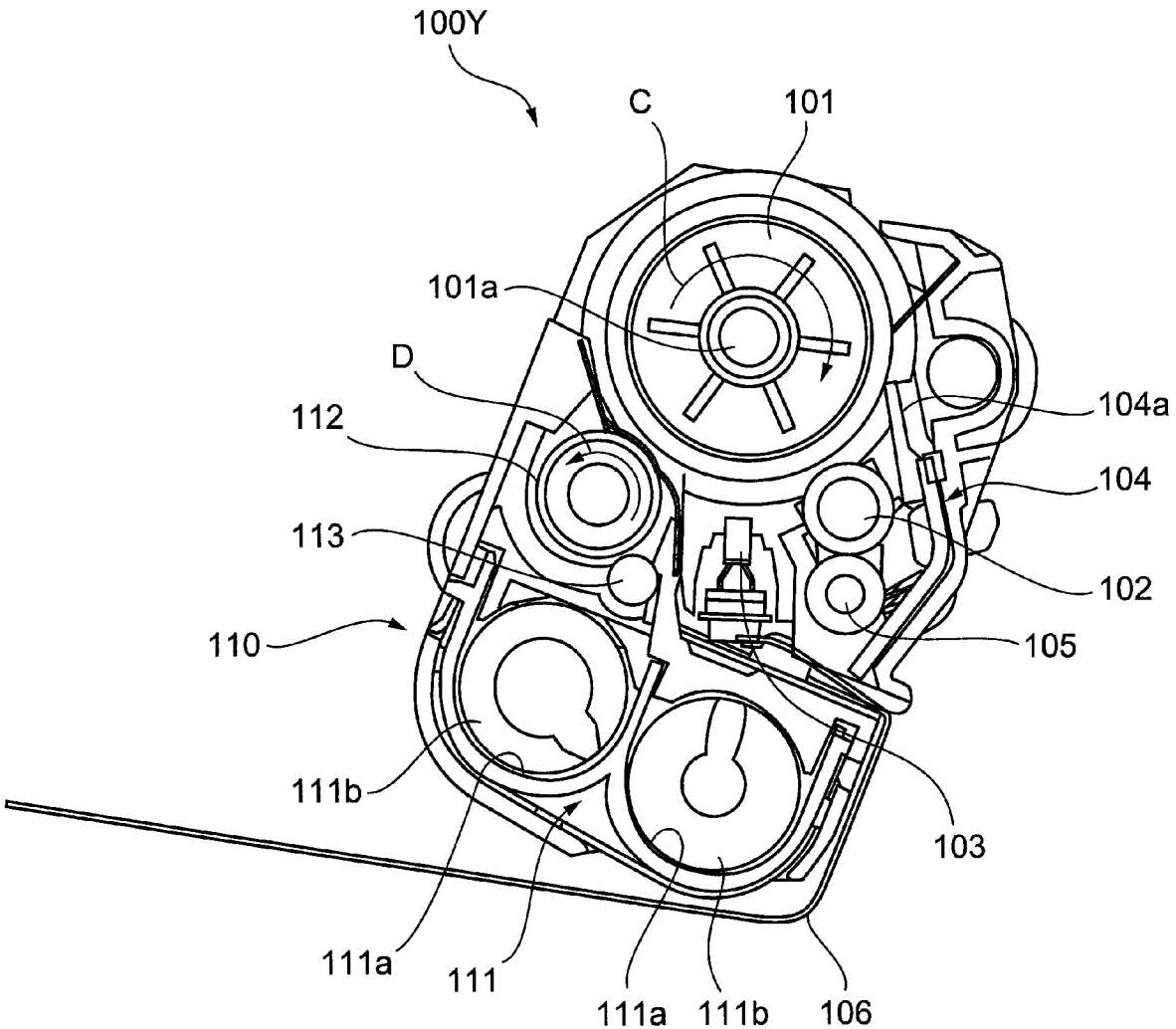
FIG. 3 is an enlarged view of the section of the image forming unit which is also illustrated in FIG. 2.

FIG. 3 is an enlarged view of the section of the image forming unit which is also illustrated in FIG. 2.

The image forming unit 100Y includes a photoreceptor roll 101, a charging roll 102, a Light Emitting Diode (LED) print head 103, a developer device 110 and a photoreceptor cleaner 104.

The photoreceptor roll 101 is shaped like a column, and rotatable around a shaft 101*a* passing through the center. This photoreceptor roll 101 is given a rotational driving force to be described later, and rotationally driven in a direction indicated by an arrow C.

Around this photoreceptor roll 101, the charging roll 102, the LED print head 103 and the developer device 110 are disposed in this order, from an upstream side to a downstream side in a rotation direction of the photoreceptor roll 101, while respectively facing the surface of the photoreceptor roll 101. Further, the primary transfer roll 251Y_1 illustrated in FIG. 2 is disposed, with respect to this image forming unit 100Y, at a position downstream from the developer device 110 and upstream from the photoreceptor cleaner 104.

The charging roll 102 applies charge to a circumferential surface of the photoreceptor roll 101. The charging roll 102 is in contact with the circumferential surface of the photoreceptor roll 101, and rotates by following the rotation of the photoreceptor roll 101. In other words, the circumferential surface of the charging roll 102 goes around as the circumferential surface of the photoreceptor roll 101 moves. Further, a cleaning roll 105 is in contact with the circumferential surface of this charging roll 102, at a position opposite the photoreceptor roll 101. The cleaning roll 105 removes the toner and the like attached to the surface of the charging roll 102.

The LED print head 103 contains plural LEDs, extends along the shaft 101*a* of the photoreceptor roll 101, and has a surface facing the circumferential surface of the photoreceptor roll 101. On this surface, lenses for light emission of the respective LEDs are arranged. To this LED print head 103, the coloring material tone data is supplied through a flat cable 106 from the control section 21. The LED according to the supplied coloring material tone data emits light, and the emitted light of the LED passes through the lens, and is emitted to the circumferential surface of the photoreceptor roll 101. As a result, an electrostatic latent image is formed on the circumferential surface of the photoreceptor roll 101.

The developer device 110 includes a toner stirring chamber 111, a development roll 112 and a trimmer roll 113.

In the toner stirring chamber 111, two stirring paths 111*a* are provided. Further, in each of the stirring paths 111*a*, the toner is contained and a stirring conveyance member 111*b* that is rotationally driven to stir and convey the toner is provided. The two stirring paths 111*a* are linked through a path not illustrated, and the toner circulates between these two stirring paths 111*a* while being stirred. Furthermore, one of the two stirring paths 111*a* is opened for the development roll 112.

The development roll 112 is rotationally driven in a direction indicated by an arrow D, around a shaft of the development roll 112, which extends along the shaft 101*a* of the photoreceptor roll 101. The development roll 112 is supplied with the toner from the one of the stirring paths 111*a*. A bias voltage is given between this development roll 112 and the photoreceptor roll 101 and thereby an electric field is formed, and the toner supplied from the stirring path 111*a* is moved to the electrostatic latent image on the circumferential surface of the photoreceptor roll 101 by this electric field. As a result, the electrostatic latent image on the circumferential surface of the photoreceptor roll 101 is developed with the toner.

The trimmer roll 113 is disposed upstream from the photoreceptor roll 101 in the rotation direction of the development roll 112, while having a predetermined space apart from the circumferential surface of the development roll 112. The trimmer roll 113 controls the adhesion thickness of the toner on the development roll 112, and forms a toner thin layer of a thickness according to the space on the circumferential surface of the development roll 112. From the development roll 112, the toner of the toner thin layer whose thickness is controlled by this trimmer roll 113 to a fixed thickness is supplied to the photoreceptor roll 101.

The toner image is formed on the circumferential surface of the photoreceptor roll 101 through the development by the developer device 110. The toner image is primarily transferred to the intermediate transfer belt 203 by the primary transfer roll 251Y_1 illustrated in FIG. 2.

The photoreceptor cleaner 104 is disposed downstream from this primary transfer roll 251Y_1 in the rotation direction of the photoreceptor roll 101, and has a cleaning blade 104*a* whose tip abuts on the circumferential surface of the photoreceptor roll 101. In the photoreceptor cleaner 104, residual toner is removed by this cleaning blade 104*a* from the circumferential surface of the photoreceptor roll 101 after the primary transfer.

In the color printer 1 illustrated in FIG. 1 and FIG. 2, the toner images of the respective color components, which are formed on the circumferential surfaces of the photoreceptor rolls 101 in the four image forming units 100Y, 100M, 100C and 100K which will be explained by using the image forming unit 100Y of yellow as the representative, are primarily transferred to the intermediate transfer belt 203 and further secondarily transferred to the sheet of paper. Subsequently, the sheet of paper undergoes fixing processing of the toner images and then ejected.

Incidentally, from now on, as for the photoreceptor roll, the developer device and the like, the description will be provided by using the reference characters in FIG. 3, without distinguishing the reference characters from each other in particular, among the four image forming units 100Y, 100M, 100C and 100K.

[Mounting Structure of Image Forming Unit]

Next, a mounting structure of the four image forming units 100Y, 100M, 100C and 100K in the color printer 1 will be described.

Figure 4:
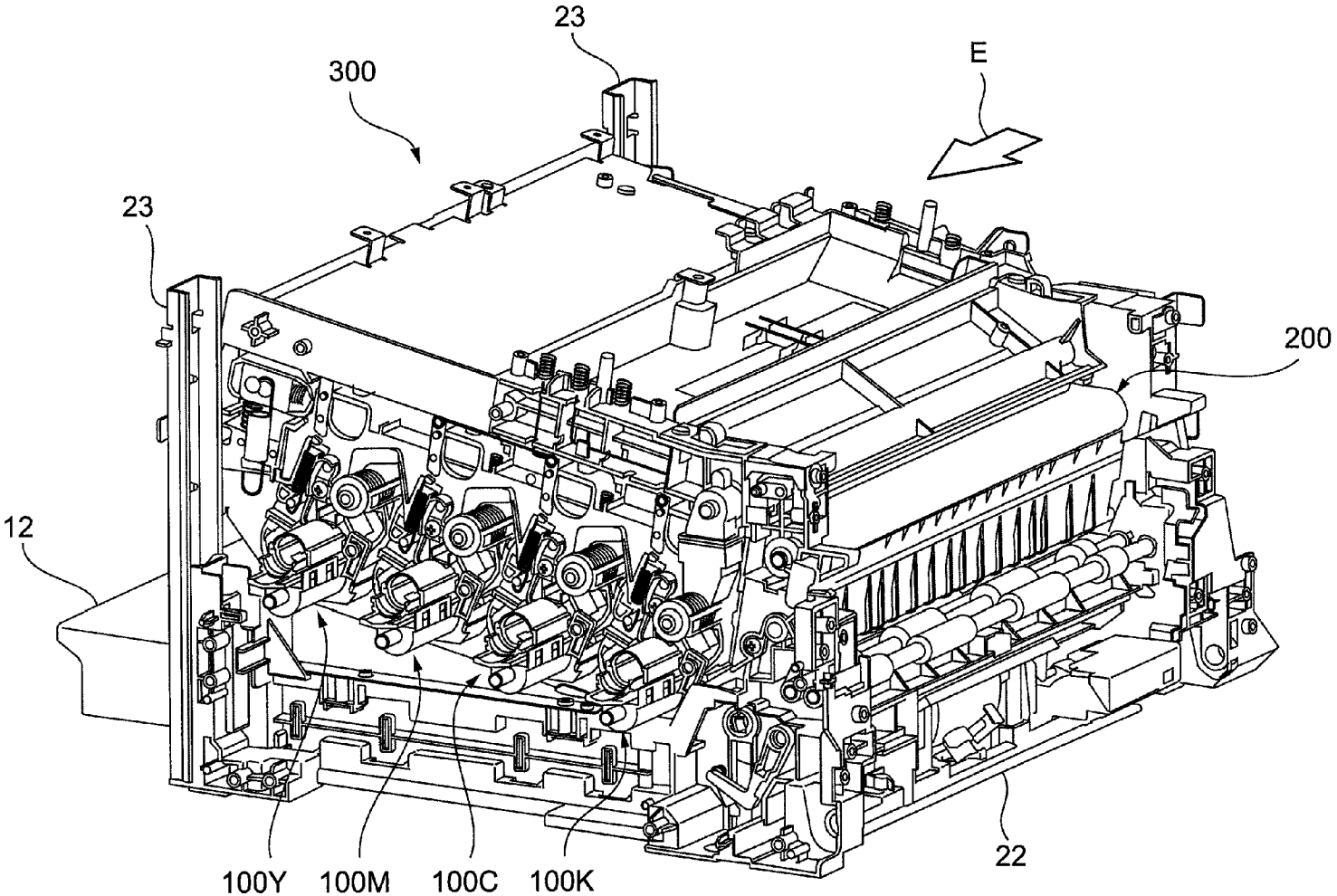
FIG. 4 is a perspective diagram that illustrates an internal structure of the color printer, by focusing on the mounting structure of the four image forming units.

FIG. 4 is a perspective diagram that illustrates an internal structure of the color printer, by focusing on the mounting structure of the four image forming units.

The color printer 1 illustrated in FIG. 1 and FIG. 2 includes, as the internal structure, a base structure 22 that houses the paper tray 12, two columns 23 extending upward from this base structure 22, and a base unit 300 fixed to the base structure 22 and the two columns 23. The base unit 300 is fixed in a state in which a part on the paper tray 12 side is lifted.

The four image forming units 100Y, 100M, 100C and 100K are incorporated into the base unit 300, together with the belt transfer section 200 and the four primary transfer sections 251Y, 251M, 251C and 251K illustrated in FIG. 2.

Figure 5:
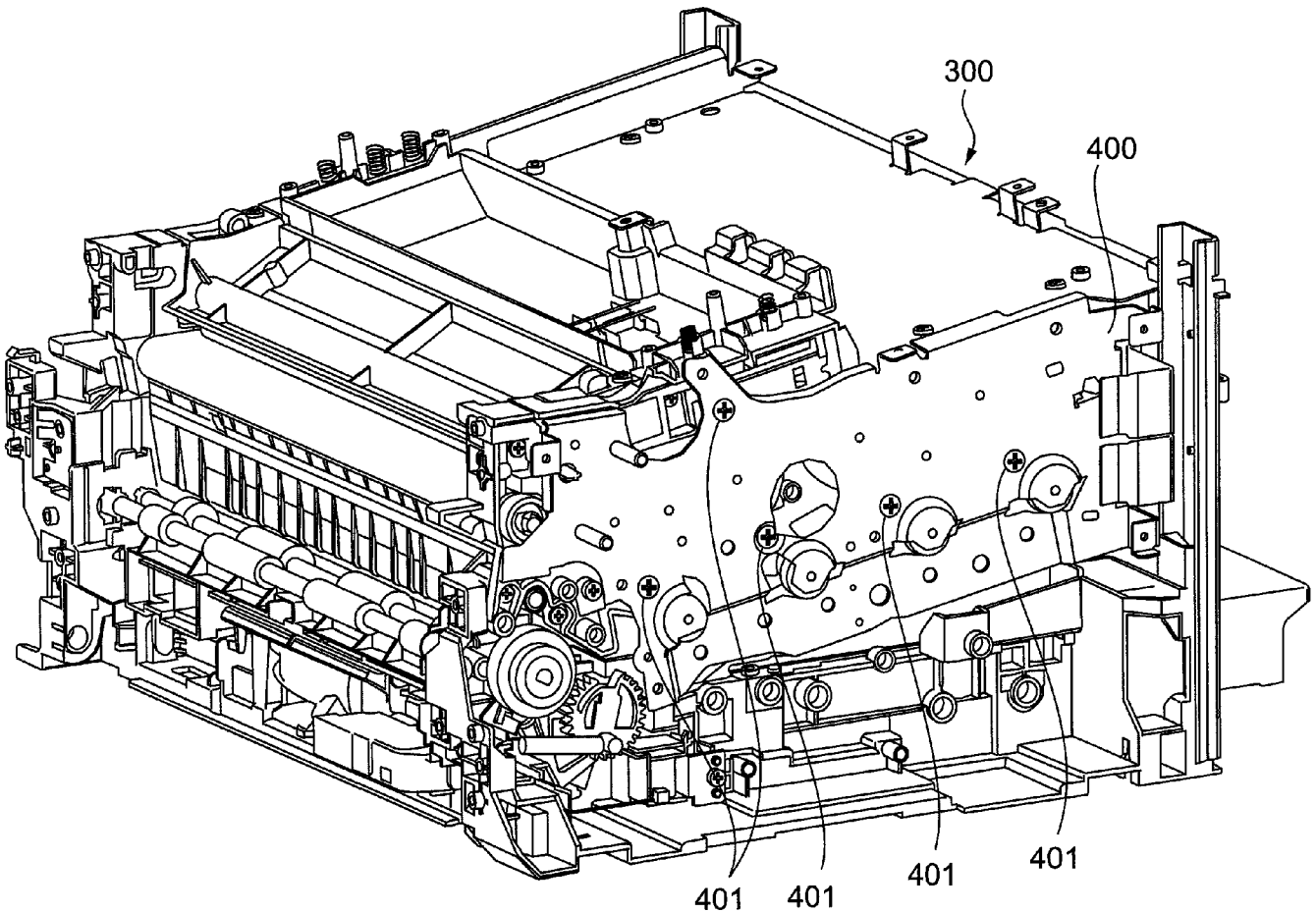
FIG. 5 is a perspective diagram of the structure illustrated in FIG. 4, when viewed from a direction indicated by an arrow E in FIG. 4.

FIG. 5 is a perspective diagram of the structure illustrated in FIG. 4, when viewed from a direction indicated by an arrow E in FIG. 4.

As illustrated in FIG. 5, to a rear side that is illustrated as a front side in FIG. 4, in the base unit 300, a drive unit 400 is fixed by screws 401. The drive unit 400 includes plural gears which rotationally drive the respective photoreceptor rolls 101 of the four image forming units 100Y, 100M, 100C and 100K. The drive unit 400 will be described later in detail.

Figure 6:
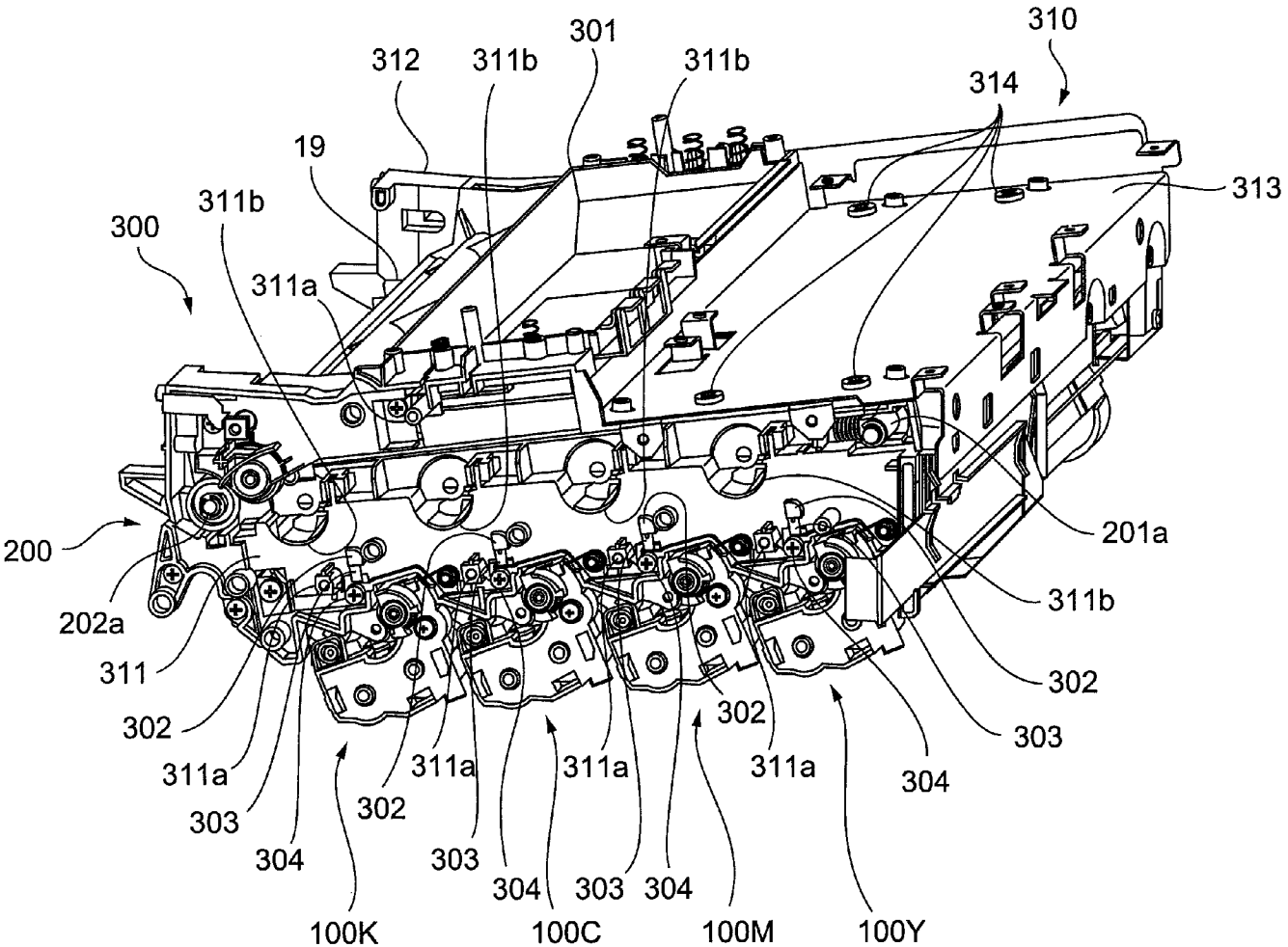
FIG. 6 is a perspective diagram that illustrates the base unit in a state where the side to which the drive unit is fixed is directed frontward, and the drive unit is removed.

FIG. 6 is a perspective diagram that illustrates the base unit in a state where the side to which the drive unit is fixed is directed frontward, and the drive unit is removed.

The base unit 300 is configured such that the four image forming units 100Y, 100M, 100C and 100K, the belt transfer section 200, and the four primary transfer sections 251Y, 251M, 251C and 251K (see FIG. 2) hidden in a frame 310 in FIG. 6 are incorporated into the frame 310.

The frame 310 includes a pair of standing walls 311 and 312 disposed to stand while being spaced apart from each other. Here, to the standing wall 311 illustrated as the front in FIG. 6, the drive unit 400 illustrated in FIG. 5 is fixed. In the following, the standing wall 311 illustrated in FIG. 6 as the front will be referred to as the drive-side standing wall 311, in a sense that the standing wall 311 is a wall to which the drive unit 400 is fixed. Further, the standing wall 312 opposite this drive-side standing wall 311 serves as a standing wall on the front surface side (front side) when viewed from a user who operates the control panel 14 illustrated in FIG. 1. In the following, the standing wall 312 opposite the drive-side standing wall 311 will be referred to as the front-side standing wall 312, in a sense that the standing wall 312 is equivalent to the front side when viewed from the user. These drive-side standing wall 311 and front-side standing wall 312 are made of resin.

The drive-side standing wall 311 is provided with bosses 311*a* in each of which there is formed an internal thread to engage with the screw 401 (see FIG. 5) for fixing the drive unit 400 to the drive-side standing wall 311. Further, the drive-side standing wall 311 is provided with four gear access ports 311*b* through which the gears provided in the drive unit 400 and rotationally driving the photoreceptor rolls 101 enter the frame 310.

The frame 310 includes, as a linking section that links the drive-side standing wall 311 and the front-side standing wall 312, a sheet metal section 313 formed by folding a metallic plate. The drive-side standing wall 311 and the front-side standing wall 312 are fixed to the sheet metal section 313 by screws 314.

This frame 310 is equivalent to an example of the frame according to the present invention. Further, the drive-side standing wall 311 and the front-side standing wall 312 are equivalent to an example of the pair of standing walls according to the present invention.

Further, between the drive-side standing wall 311 and the front-side standing wall 312, the belt cleaner 19 illustrated in FIG. 2 is disposed, and between this belt cleaner 19 and the sheet metal section 313, a power-supply-unit mounting section 301 to be mounted with the power supply unit 15 illustrated in FIG. 2 is disposed. The power supply unit 15 supplies high voltage for the transfer bias and a developing bias, and low voltage for the sensor and the like.

Furthermore, between the drive-side standing wall 311 and the front-side standing wall 312, the drive roll 201 and the tension roll 202 of the belt transfer section 200 illustrated in FIG. 2 extend. Both ends of a rotation axis 201*a* of the drive roll 201 penetrate the drive-side standing wall 311 and the front-side standing wall 312, and both ends of the rotation axis 202*a* of the tension roll 202 also penetrate the drive-side standing wall 311 and the front-side standing wall 312. As these rotation axes 201*a* and 202*a* penetrate, the drive roll 201 and the tension roll 202 are supported by the drive-side standing wall 311 and the front-side standing wall 312 directly or indirectly via bearings and the like. FIG. 6 illustrates the end of the rotation axis 201*a* of the drive roll 201 and the end of the rotation axis 202*a* of the tension roll 202, in a state of penetrating the drive-side standing wall 311.

Each of the image forming units 100Y, 100M, 100C and 100K is supported by the frame 310. Although the details will be described later, from both ends of each of the image forming units 100Y, 100M, 100C and 100K, both ends of the shaft 101*a* of the photoreceptor roll 101 illustrated in FIG. 3 protrude. Here, this color printer 1 is a printer that does not assume the replacement of the photoreceptor roll 101 as described above. Thus, in this color printer 1, by taking advantage of the fact that the replacement of the photoreceptor roll 101 is not assumed, each of the image forming units 100Y, 100M, 100C and 100K is supported by the frame 310, in a state in which both ends of the shaft 101*a* penetrate the drive-side standing wall 311 and the front-side standing wall 312.

The drive-side standing wall 311 is provided with four cover sections 302 that cover the respective ends of the shafts 101*a* penetrating the drive-side standing wall 311. Further, to the drive-side standing wall 311, flat springs 303 each having one end extending within the cover section 302 are attached. In each of the cover sections 302, the end of each of the shafts 101*a* penetrating the drive-side standing wall 311 is pressed by each of the flat springs 303, in a direction to push each of the shafts 101*a* into the frame 310.

In this color printer 1, replacement of the photoreceptor roll 101 is not assumed and thus, the four image forming units 100Y, 100M, 100C and 100K are fixed to the frame 310. Here, as described above, both ends of the shaft 101*a* of the photoreceptor roll 101 in each of the image forming units 100Y, 100M, 100C and 100K penetrate the drive-side standing wall 311 and the front-side standing wall 312. For this reason, the image forming units 100Y, 100M, 100C and 100K may be fixed to the frame 310 by merely stopping the rotation of each of the image forming units 100Y, 100M, 100C and 100K around the shaft 101*a* of the photoreceptor roll 101. Thus, in this color printer 1, for fixing each of the image forming units 100Y, 100M, 100C and 100K to the frame 310, there is adopted such a structure that each of the image forming units 100Y, 100M, 100C and 100K is fixed to the drive-side standing wall 311 with a single screw 304.

Figure 7:
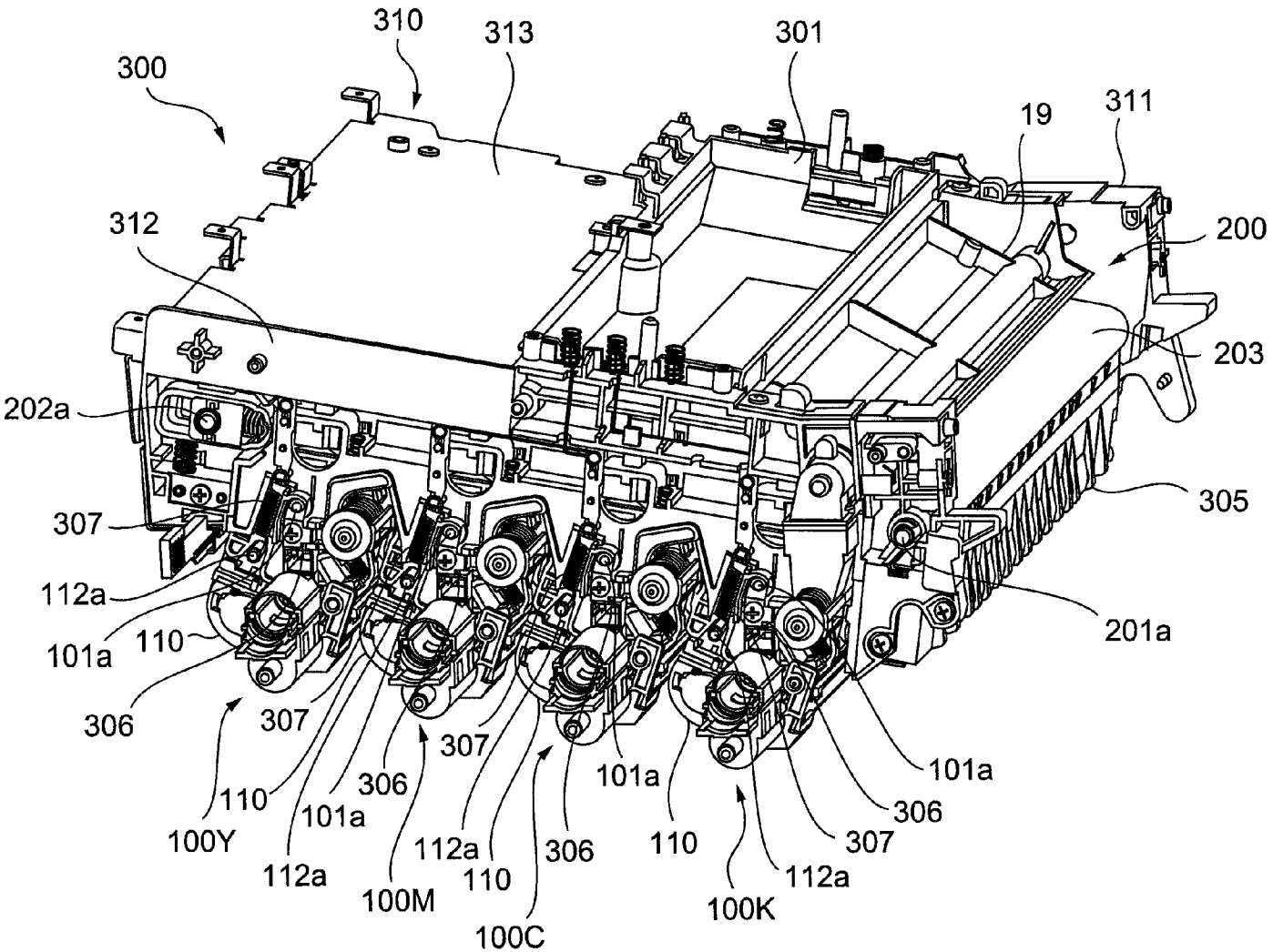
FIG. 7 is a perspective view of the base unit with the front-side standing wall directed frontward.

FIG. 7 is a perspective view of the base unit with the front-side standing wall directed frontward.

FIG. 7 illustrates, as for the belt transfer section 200 incorporated into the frame 310, the intermediate transfer belt 203 that circularly moves while being held by: the end of the rotation axis 201*a* of the drive roll 201 and the end of the rotation axis 202*a* of the tension roll 202, which are in the state of penetrating the front-side standing wall 312; and the drive roll 201 and the tension roll 202.

This belt transfer section 200 is equivalent to an example of the intermediate transfer section according to the present invention.

Here, as described above with reference to FIG. 2, the image density sensor 18 is disposed at the position downstream from the image forming unit 100K of black in the circularly moving direction of the intermediate transfer belt 203, and below the belt cleaner 19 across the intermediate transfer belt 203 interposed in between.

As illustrated in FIG. 7, between the front-side standing wall 312 and the drive-side standing wall 311, a sensor housing section 305 that houses the image density sensor 18 is disposed at a position below the belt cleaner 19 across the intermediate transfer belt 203 interposed in between.

On the side where the front-side standing wall 312 is provided, the end, which is in the state of penetrating the front-side standing wall 312, of the shaft 101*a* in each of the image forming units 100Y, 100M, 100C and 100K is exposed. In addition, a flat spring 306 whose one end extends up to this exposed end of each of the shafts 101*a* is attached to the front-side standing wall 312. Of each of the flat springs 306, the one end extending up to the end of each of the shafts 101*a* touches a lower half of the end of each of the shafts 101*a*, thereby pressing the shaft 101*a* in a direction of pushing the shaft 101*a* into the frame 310. As described earlier, each of the shafts 101*a* is also pressed by the flat spring 303 from the drive-side standing wall 311 side in the direction to be pushed into the frame 310. In other words, each of the shafts 101*a* is supported by the frame 310 in a state of being pressurized in the directions to be pushed inward from both the drive-side standing wall 311 side and the front-side standing wall 312 side.

Here, as described above with reference to FIG. 3, the developer device 110 having the development roll 112 extending along the photoreceptor roll 101 is incorporated into each of the image forming units 100Y, 100M, 100C and 100K. Thus, the development roll 112 extends between the front-side standing wall 312 and the drive-side standing wall 311. Further, the development roll 112 has a shaft 112*a* penetrating the center of this development roll 112, and of both ends of this shaft 112*a*, the end on the front-side standing wall 312 side protrudes from the developer device 110. Furthermore, the end of this shaft 112*a* is exposed from the front-side standing wall 312. Between the developer device 110 and the front-side standing wall 312, a pulling spring 307 is disposed as will be described later. Each of the pulling springs 307 pulls up the shaft 112*a* of the development roll 112 toward the front-side standing wall 312, thereby pressurizing the development roll 112 in each of the developer devices 110 toward the photoreceptor roll 101.

Figure 8:
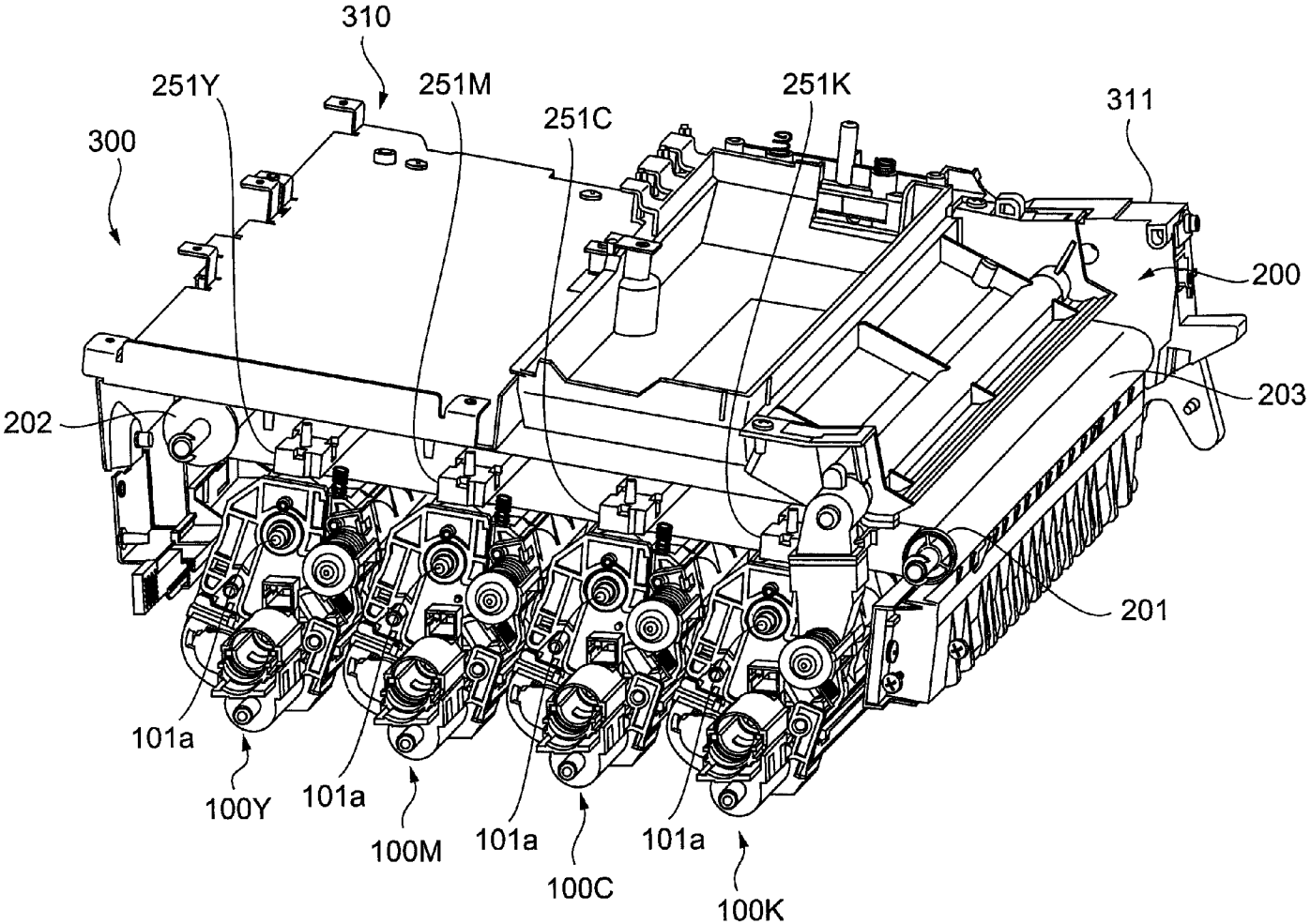
FIG. 8 is a perspective diagram of the base unit in a state of being oriented in the same direction as the direction in FIG. 7 and the front-side standing wall being removed.

FIG. 8 is a perspective diagram of the base unit in a state of being oriented in the same direction as the direction in FIG. 7 and the front-side standing wall being removed.

FIG. 8 illustrates the drive roll 201 and the tension roll 202 of the belt transfer section 200 hidden behind the front-side standing wall 312 in FIG. 7, and the intermediate transfer belt 203. FIG. 8 also illustrates the four primary transfer sections 251Y, 251M, 251C and 251K. The four image forming units 100Y, 100M, 100C and 100K are arranged along the intermediate transfer belt 203 in the frame 310.

FIG. 8 also illustrates an upper half of each of the image forming units 100Y, 100M, 100C and 100K hidden behind the front-side standing wall 312 in FIG. 7. There is illustrated the end of the shaft 101*a* of the photoreceptor roll 101 protruding from this upper half of each of the image forming units 100Y, 100M, 100C and 100K.

Figure 9:
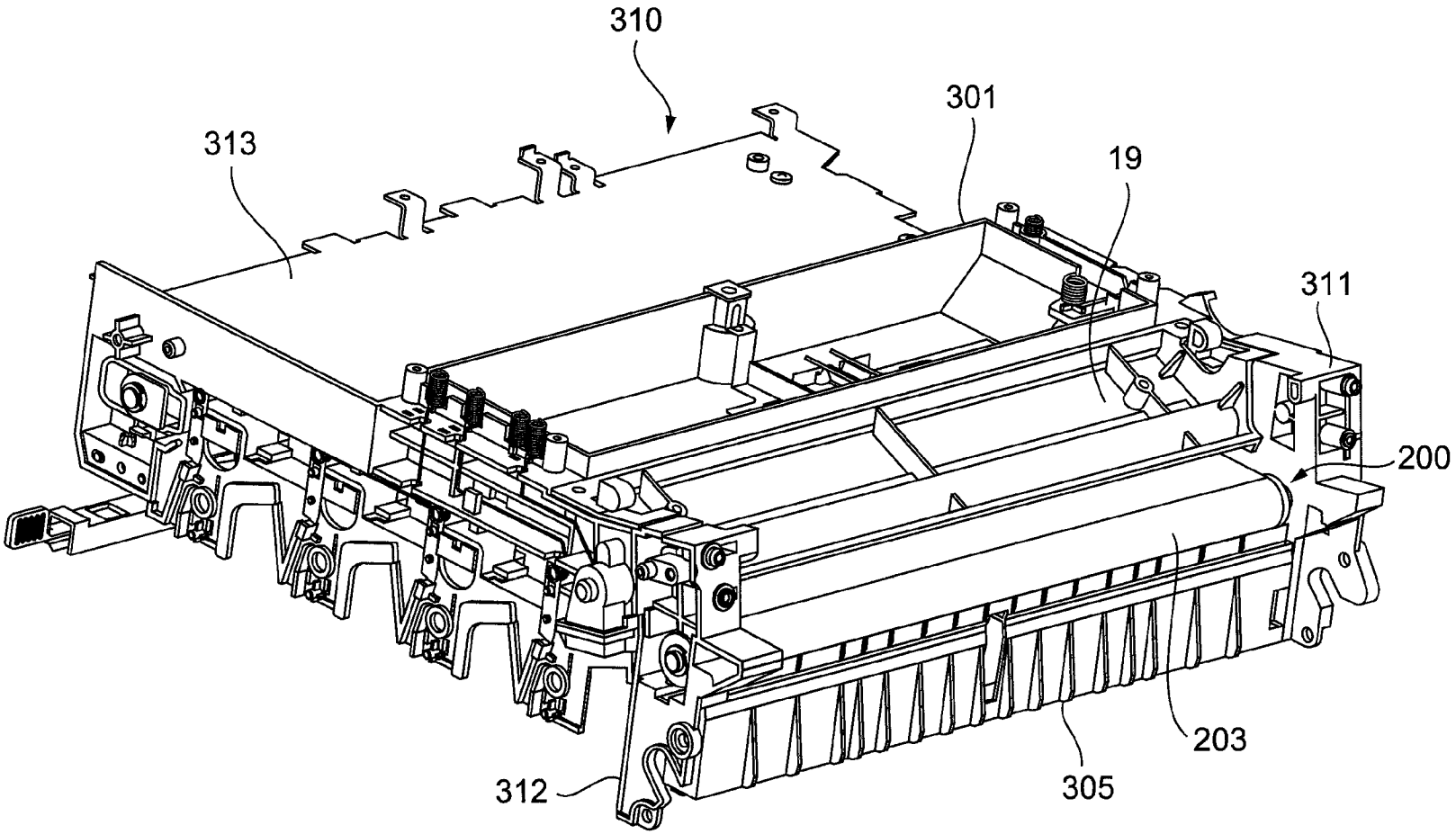
FIG. 9 is a perspective diagram that illustrates a state in which the four image forming units are removed from the base unit.

FIG. 9 is a perspective diagram that illustrates a state in which the four image forming units are removed from the base unit.

As described earlier, the frame 310 includes the front-side standing wall 312 and the drive-side standing wall 311 made of resin, and the sheet metal section 313 that links these two standing walls. The frame 310 using a resin component and a metal component together in this way has greater rigidity than a case in which the entire frame is made of resin, and is lighter in weight than a case in which the entire frame is a sheet metal workpiece. Further, the sheet metal section 313 serves as a shield preventing the passage of electromagnetic noise between the inside and the outside of the base unit 300.

In addition, as described earlier, between the front-side standing wall 312 and the drive-side standing wall 311 of the frame 310, the power-supply-unit mounting section 301, the belt cleaner 19 and the sensor housing section 305 are disposed. The frame 310, the power-supply-unit mounting section 301, the belt cleaner 19 and the sensor housing section 305 combined are shaped like a box whose lower part in FIG. 9 is open. The four image forming units 100Y, 100M, 100C and 100K are disposed along the intermediate transfer belt 203 of the belt transfer section 200, in a space inside of this box.

Figure 10:
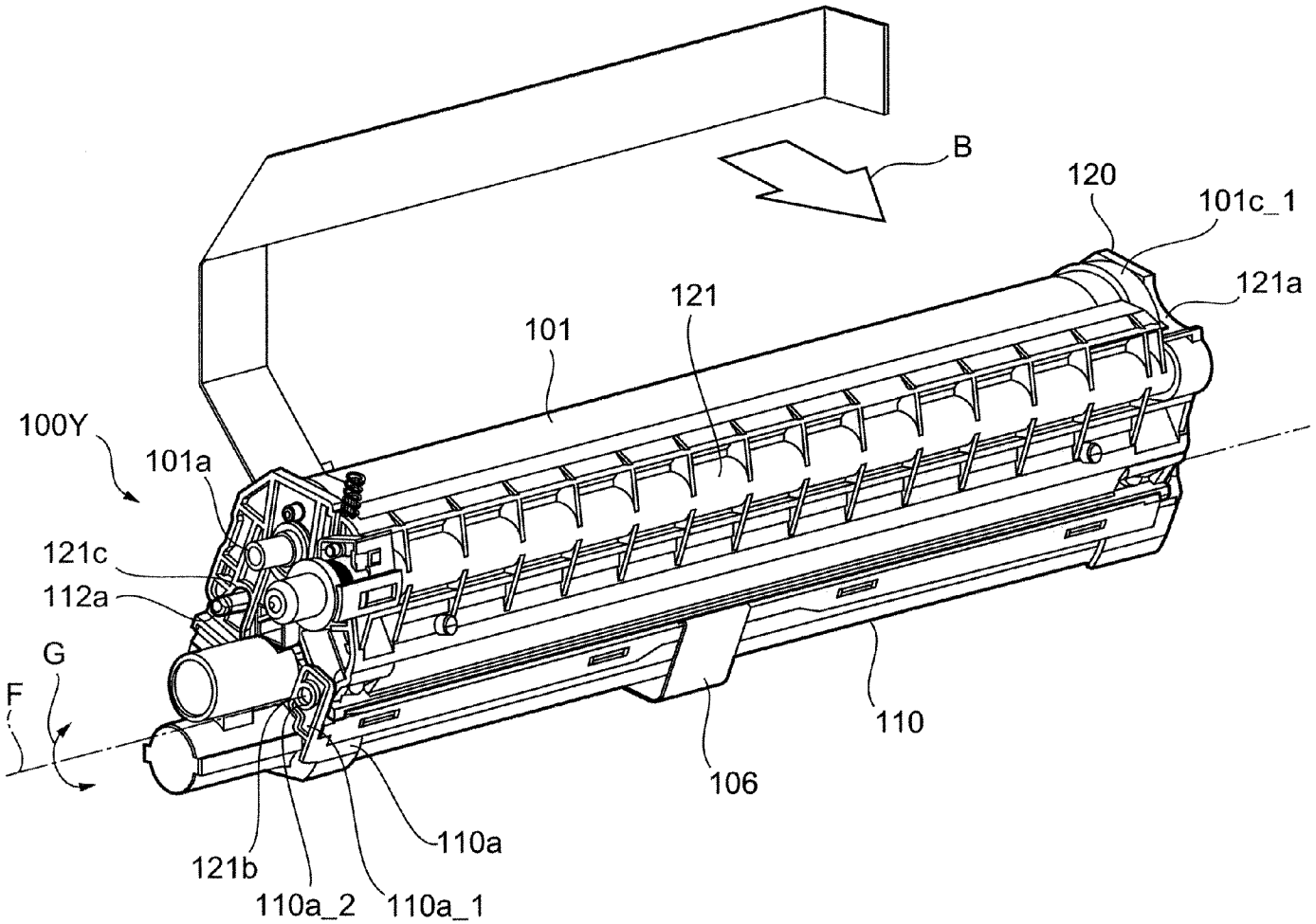
FIG. 10 is a perspective diagram of the image forming unit in a posture in which the end facing the front-side standing wall is visible.

FIG. 10 is a perspective diagram of the image forming unit in a posture in which the end facing the front-side standing wall is visible.

Incidentally, as mentioned earlier, the image forming units 100Y, 100M, 100C and 100K have the structures similar to each other except that the colors of the toners in use are different. FIG. 10 illustrates the image forming unit 100Y in charge of yellow as a representative.

The image forming unit 100Y is configured such that the developer device 110 is incorporated into a photoreceptor unit 120 in which the photoreceptor roll 101 is housed.

The photoreceptor unit 120 includes a photoreceptor-unit frame 121 as described below. The photoreceptor-unit frame 121 has an end surface facing the front-side standing wall 312 and an end surface facing the drive-side standing wall 311. Further, the photoreceptor-unit frame 121 covers, of the surface of the photoreceptor roll 101, a part downstream in the moving direction (the direction indicated by the arrow B) of the intermediate transfer belt 203 illustrated in FIG. 2.

The photoreceptor roll 101 has a photoreceptor-side gear 101*b* that receives a rotational driving force from the drive unit 400 illustrated in FIG. 5. In a state in which the image forming unit 100Y is incorporated into the frame 310, the photoreceptor roll 101 is housed in the photoreceptor-unit frame 121, with this photoreceptor-side gear 101*b* being directed toward the drive-side standing wall 311. Further, both ends of the shaft 101*a* of this photoreceptor roll 101 penetrate both end surfaces of the photoreceptor-unit frame 121 and protrude.

The gears for driving the photoreceptors, which will be described later, in the drive unit 400 illustrated in FIG. 5 enter the frame 310 of the base unit 300 from the gear access ports

311*b* in the drive-side standing wall 311 illustrated in FIG. 6, and go into engagement with the photoreceptor-side gears 101*b* of the photoreceptors roll 101. The photoreceptor-unit frame 12 has a side wall having an end surface that faces the drive-side standing wall 311, and this side wall is provided with a notch 121*a* to avoid interference with the gear provided on the drive unit 400 to mesh with the photoreceptor-side gear 101*b*.

Further, inside the photoreceptor-unit frame 121, in addition to the photoreceptor roll 101, the charging roll 102 illustrated in FIG. 3, the cleaning roll 105 of the charging roll 102, the LED print head 103, the photoreceptor cleaner 104 are disposed along the photoreceptor roll 101.

The developer device 110 contains the two stirring paths 111*a* illustrated in FIG. 3, and includes a developer-device frame 110*a* in which the development roll 112 is housed.

Here, a protrusion 121*b* is provided on each of the both end surfaces of the photoreceptor-unit frame 121. Further, a part of each of the both end surfaces of the developer-device frame 110*a* forms a jutting section 110*a* 1 that juts out to cover a portion where the protrusion 121*b* is provided on each of the both end surfaces of the photoreceptor-unit frame 121. In this jutting section 110*a* 1, a through hole 110*a* 2 is formed. By inserting the protrusion 121*b* on each of the both end surfaces of the photoreceptor-unit frame 121 into the through hole 110*a* 2 of the jutting section 110*a* 1 covering each of the end surfaces, the developer device 110 is installed in the photoreceptor unit 120 so as to be rotatable in a direction indicated by an arrow G, around an axis F connecting the protrusions 121*b* on the both end surfaces of the photoreceptor-unit frame 121.

Further, as described above, the shaft 112*a* of the development roll 112 protrudes from the end surface, which is on the front-side standing wall 312 side, of the developer device 110. Furthermore, in the side wall of the photoreceptor-unit frame 121, on the side wall having the end surface facing the front-side standing wall 312, there is formed the notch 121 avoiding a moving path of the shaft 112*a* of the development roll 112 in the developer device 110 rotating in the direction indicated by the arrow G.

In addition, in the image forming unit 100Y, the space extending along the photoreceptor roll 101 is formed between the photoreceptor unit 120 and the developer device 110. From this space, the flat cable 106, which carries the coloring material tone data to the LED print head 103 illustrated in FIG. 3, extends to the outside of the image forming unit 100Y.

As described above using the image forming unit 100Y of yellow as a representative, the shaft 101*a* of the photoreceptor roll 101 protrudes from the both ends of each of the image forming units 100Y, 100M, 100C and 100K. Further, as described above, each of the image forming units 100Y, 100M, 100C and 100K is housed in the frame 310 of the base unit 300, in the state in which the both ends of the shaft 101*a* of the photoreceptor roll 101 penetrate the drive-side standing wall 311 and the front-side standing wall 312. Furthermore, the image forming units 100Y, 100M, 100C and 100K are fixed to the drive-side standing wall 311 by the screws. The four image forming units 100Y, 100M, 100C and 100K are equivalent to an example of the plurality of built-in bodies according to the present invention.

There will be described below the details of: a penetration structure in which the both ends of the shaft 101*a* of the photoreceptor roll 101 penetrate the drive-side standing wall 311 and the front-side standing wall 312; and a screw-fixing structure of fixing the image forming units 100Y, 100M, 100C and 100K to the drive-side standing wall 311.

Figure 11:
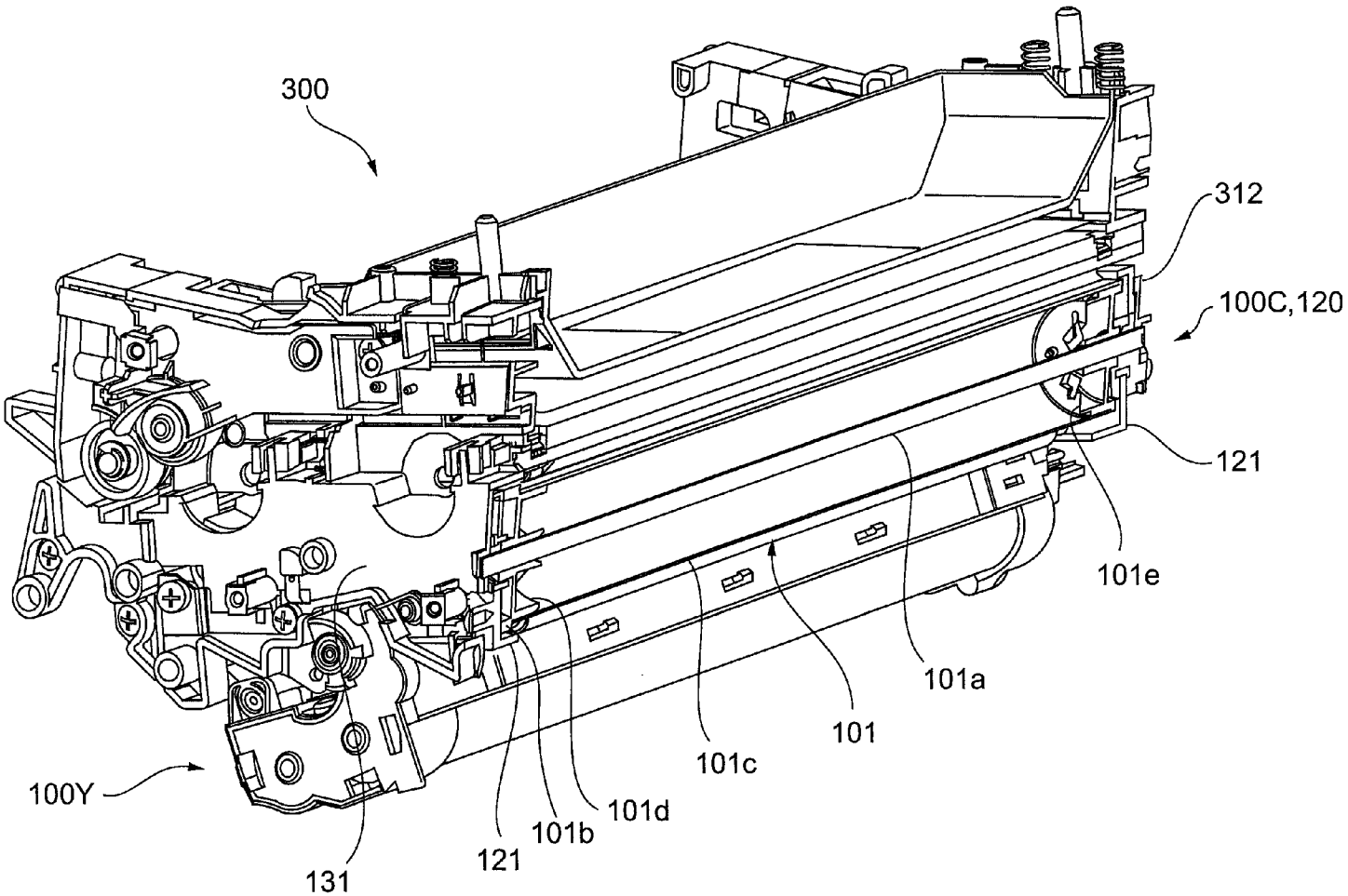
FIG. 11 is a perspective diagram of the base unit, in the same posture as the posture of the base unit in FIG. 6, and also in a state of being cut along a section that passes though the shaft of the photoreceptor roll of cyan and spreads along this shaft.

FIG. 11 is a perspective diagram of the base unit, in the same posture as the posture of the base unit in FIG. 6, and also in a state of being cut along a section that passes though the shaft of the photoreceptor roll of cyan and spreads along this shaft.

In FIG. 11, the image forming unit 100C of cyan is illustrated in such a state that as a result of cutting along the above-mentioned section, the section of the photoreceptor unit 120 remaining on the image forming unit 100Y of yellow side appears.

The photoreceptor roll 101 includes: the shaft 101*a*, a cylindrical roll main unit 101*c*, a drive-side cover section 101*d* which covers a part on the drive-side standing wall 311 side of the roll main unit 101*c* and is provided with a photoreceptor-side gear 101*b*, and a front-side cover section 101*e* which covers a part on the front-side standing wall 312 side of the roll main unit 101*c*.

The shaft 101*a* passes through the center of the roll main unit 101*c*. Further, the drive-side cover section 101*d* and the front-side cover section 101*e* are penetrated by both ends of this shaft 101*a*. Here, the drive-side cover section 101*d* and the front-side cover section 101*e* are penetrated by this shaft 101*a* to be slidable with respect to the shaft 101*a*. Thus, the photoreceptor roll 101 is rotatable around the shaft 101*a*.

As also illustrated in FIG. 10, the both ends of the shaft 101*a* of this photoreceptor roll 101 protrude from the photoreceptor unit 120 by penetrating the photoreceptor-unit frame 121, and further penetrate the drive-side standing wall 311 and the front-side standing wall 312.

Figure 12:
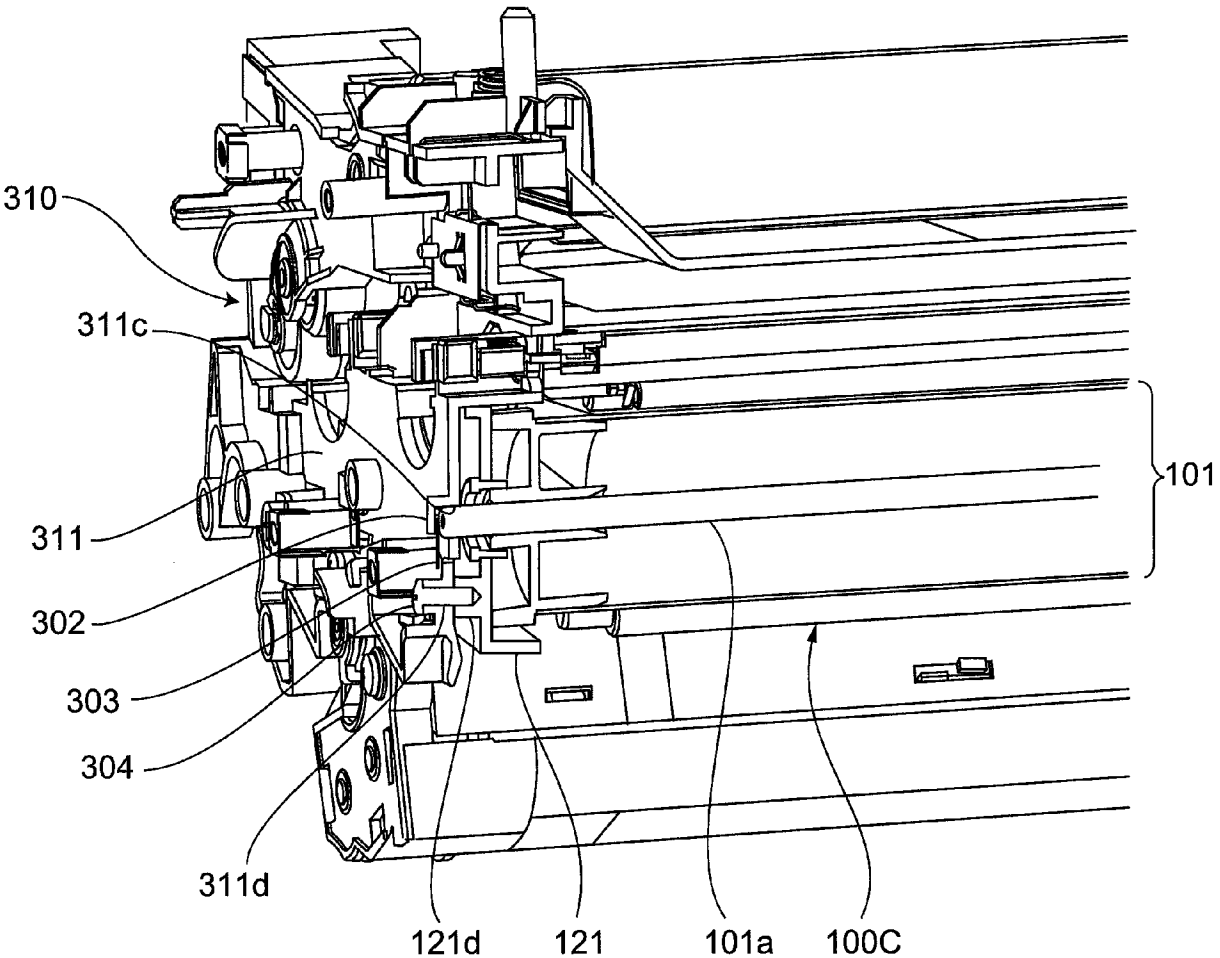
FIG. 12 is an enlarged view of a part where the shaft of the photoreceptor roll penetrates the drive-side standing wall.

FIG. 12 is an enlarged view of a part where the shaft of the photoreceptor roll penetrates the drive-side standing wall.

A through hole 311*c* is formed in the drive-side standing wall 311, and the end of the shaft 101*a* of the photoreceptor roll 101 passes through this through hole 311*c*. Further, the end of the shaft 101*a* after passing through this through hole 311*c* and penetrating the drive-side standing wall 311 is covered with the cover section 302 that is also illustrated in FIG. 6. Furthermore, in this cover section 302, one end of the flat spring 303 that is also illustrated in FIG. 6 extends. This flat spring 303 presses the shaft 101*a* in the direction of pushing the shaft 101*a* into the frame 310.

A boss 121*d* in which an internal thread is formed is provided on the end surface on the drive-side standing wall 311 side of the photoreceptor-unit frame 121. Further, a threaded hole 311*d* is formed at a part of the drive-side standing wall 311, corresponding to this boss 121*d*. Furthermore, the screw 304, which is also illustrated in FIG. 6, is inserted into this threaded hole 311*a* and then screwed to engage with the internal thread of the boss 121*d* provided on the end surface of the photoreceptor-unit frame 121, so that the photoreceptor-unit frame 121, and also the image forming unit 100C, are fixed to the drive-side standing wall 311 by the screw.

Figure 13:
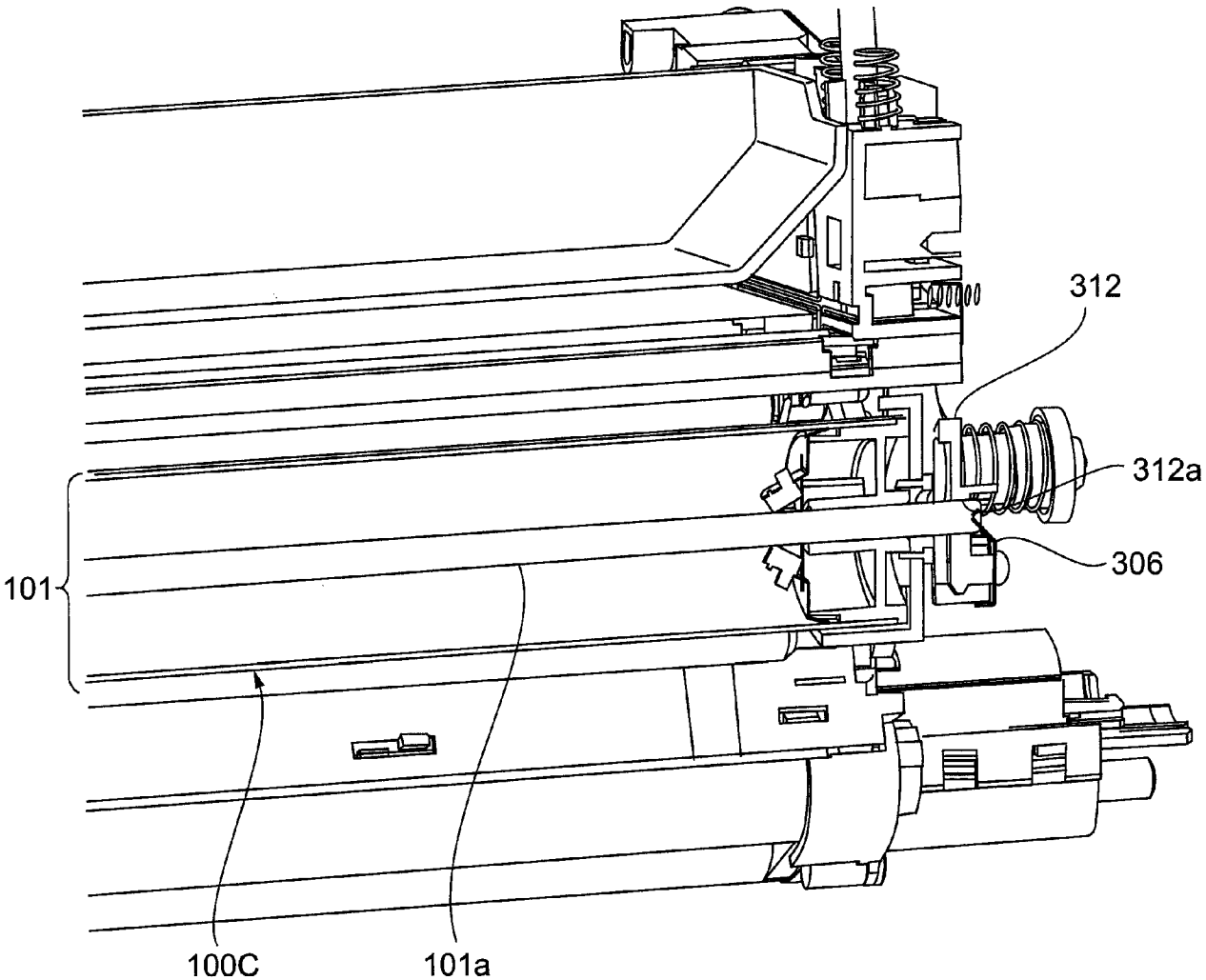
FIG. 13 is an enlarged view of a part where the shaft of the photoreceptor roll penetrates the front-side standing wall.

FIG. 13 is an enlarged view of a part where the shaft of the photoreceptor roll penetrates the front-side standing wall.

A through hole 312*a* is formed in the front-side standing wall 312, and the end of the shaft 101*a* of the photoreceptor roll 101 is inserted into this through hole 312*a*. Further, one end of the flat spring 306, which is also illustrated in FIG. 7, extends up to the end of the shaft 101*a* after passing though this through hole 312*a* and penetrating the front-side standing wall 312, and this one end touches a lower half of the end of the shaft 101*a*. Furthermore, this flat spring 306 presses the shaft 101*a* in a direction of pushing the shaft 101*a* into the frame 310.

Incidentally, up to this point, with reference to FIG. 11 to FIG. 13, there have been described, of the image forming unit 100C of cyan, the penetration structure of the both ends of the shaft 101*a* of the photoreceptor roll 101, and the screw-fixing structure of fixing the image forming unit 100C to the drive-side standing wall 311. However, these structures also apply to the image forming units 100Y, 100M and 100K of other colors.

As described above, in the color printer 1, the both ends of the shaft 101*a* of the photoreceptor roll 101 in each of the image forming units 100Y, 100M, 100C and 100K penetrate the drive-side standing wall 311 and the front-side standing wall 312 of the frame 310. This frame 310 supports the drive roll 201 and the tension roll 202 holding the intermediate transfer belt 203. Further, the image forming units 100Y, 100M, 100C and 100K are fixed to the drive-side standing wall 311 by the screws.

In this color printer 1, the drive-side standing wall 311, the front-side standing wall 312 and the photoreceptor-unit frame 121 are processed, and the base unit 300 is assembled, so that the photoreceptor roll 101 of each of the image forming units 100Y, 100M, 100C and 100K is disposed at a position relative to the intermediate transfer belt 203 within tolerance determined beforehand in a design stage.

Here, for example, an image forming apparatus such as a color printer assuming replacement of a photoreceptor roll for, for example, maintenance and the like, the photoreceptor roll needs to be disposed at a position in tolerance relative to the intermediate transfer belt 203 every time the replacement takes place, in order to achieve good image quality. For this reason, high precision control is required for the replacement.

In the color printer 1 of the present exemplary embodiment, the both ends of the shaft 101*a* of the photoreceptor roll 101 are caused to penetrate the drive-side standing wall 311 and the front-side standing wall 312, and the image forming units 100Y, 100M, 100C and 100K are fixed to the frame 310 by the screws. Thus, displacement of the four-colored toner images on the intermediate transfer belt 203 is at a relative position in the tolerance determined beforehand in the design stage.

Further, as described with reference to FIG. 3, each of the image forming units 100Y, 100M, 100C and 100K contains the LED print head 103 that emits the light of the LED to the charged circumferential surface of the photoreceptor roll 10 and thereby forming the electrostatic latent image on the circumferential surface, and this LED print head 103 is fixed to the photoreceptor-unit frame 121.

Here, generally, an LED print head has a service life longer than that the service life of a photoreceptor roll and thus, replacement of the photoreceptor roll is assumed, and in an image forming apparatus using the LED print head for image formation, replacement of the LED print head together with photoreceptor roll is avoided in many cases. For this reason, many of such image forming apparatus are provided with an evacuation system for evacuating, at the time of replacing the photoreceptor roll, the LED print head from a replacement path of the photoreceptor roll. In order to obtain good image quality, this evacuation system is required to have a high precision structure for returning the once-evacuated LED print head to a position within predetermined tolerance.

In contrast, in the color printer 1, replacement of the photoreceptor roll is not assumed and thus, such an evacuation system is not provided to achieve good image quality. In the color printer 1, merely attaching the LED print head 103 to a predetermined position within predetermined tolerance at the time of assembling each of the image forming units 100Y, 100M, 100C and 100K is good enough for achievement of good image quality. Further, the LED print head 103 is disposed and fixed within the image forming units 100Y, 100M, 100C and 100K and thus, even if the image forming unit shakes due to a cause such as the driving of the development roll 112, the photoreceptor roll 101, or the like, the LED print head 103 shakes integrally, and fluctuations in the focal length are less than the case in which the evacuation system is provided.

Here, as described with reference to FIG. 7, between the developer device 110 of each of the image forming units 100Y, 100M, 100C and 100K and the front-side standing wall 312, the pulling spring 307 that pulls the development roll 112 toward the photoreceptor roll 101 side is installed.

[Urging of Development Roll]

Urging of the development roll 112 by this pulling spring 307 will be described below in detail.

Figure 14:
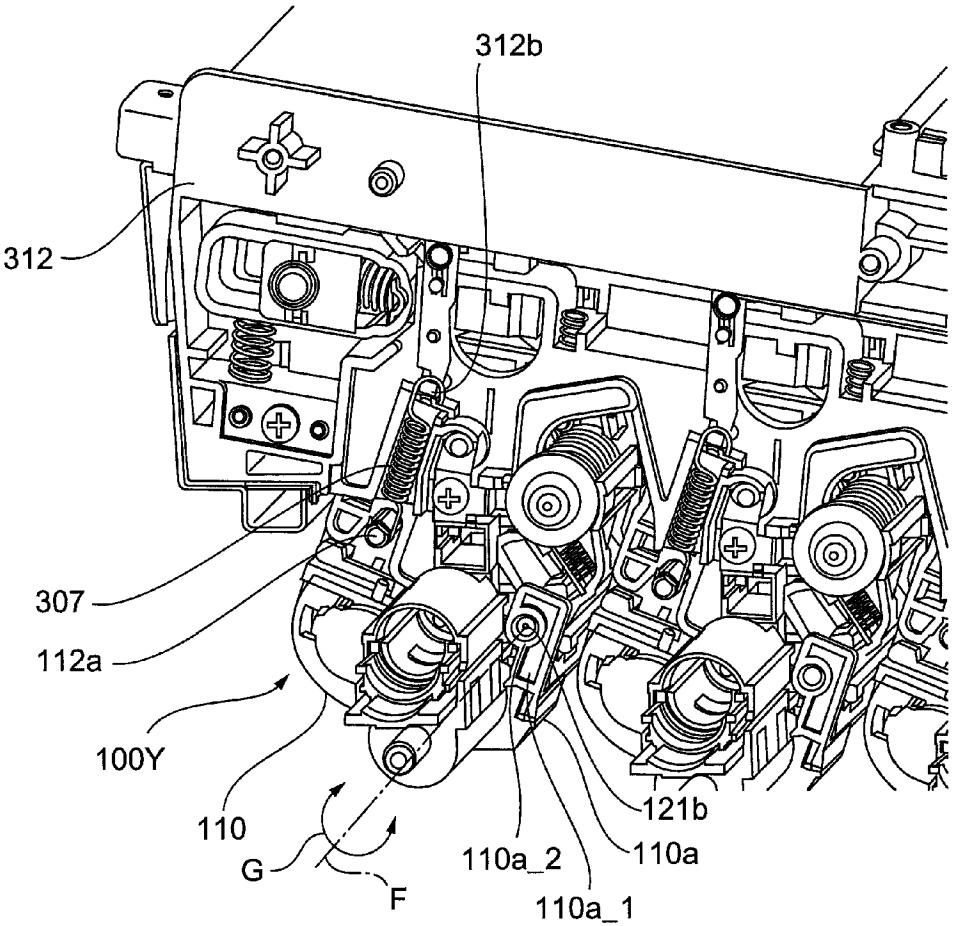
FIG. 14 is an enlarged view of a part around the pulling spring that urges the development roll of the image forming unit of yellow in FIG. 7.

FIG. 14 is an enlarged view of a part around the pulling spring that urges the development roll of the image forming unit of yellow in FIG. 7.

In the image forming unit 100Y, the developer device 110 protrudes from the end surface of the photoreceptor-unit frame 121 (see FIG. 10), and is rotatable in the direction indicated by the arrow G, around the axis F passing though the protrusion 121*b* fitted in the through hole 110*a* 2 formed in the jutting section 110*a* 1 of the developer-device frame 110*a*. The pulling spring 307 is disposed between this developer device 110 and the front-side standing wall 312.

On the front-side standing wall 312, there is provided a key section 312*b* to which one end of the pulling spring 307 is hooked. While the one end is hooked to this key section 312*b*, the other end of the pulling spring 307 is hooked to the shaft 112*a* of the development roll 112. This pulling spring 307 pulls up the shaft 112*a* of the development roll 112 toward the front-side standing wall 312. This pulling up by the pulling spring 307 urges the development roll 112 toward the photoreceptor roll 101 side. The pulling spring 307 is equivalent to an example of the urging spring according to the present invention.

Figure 15:
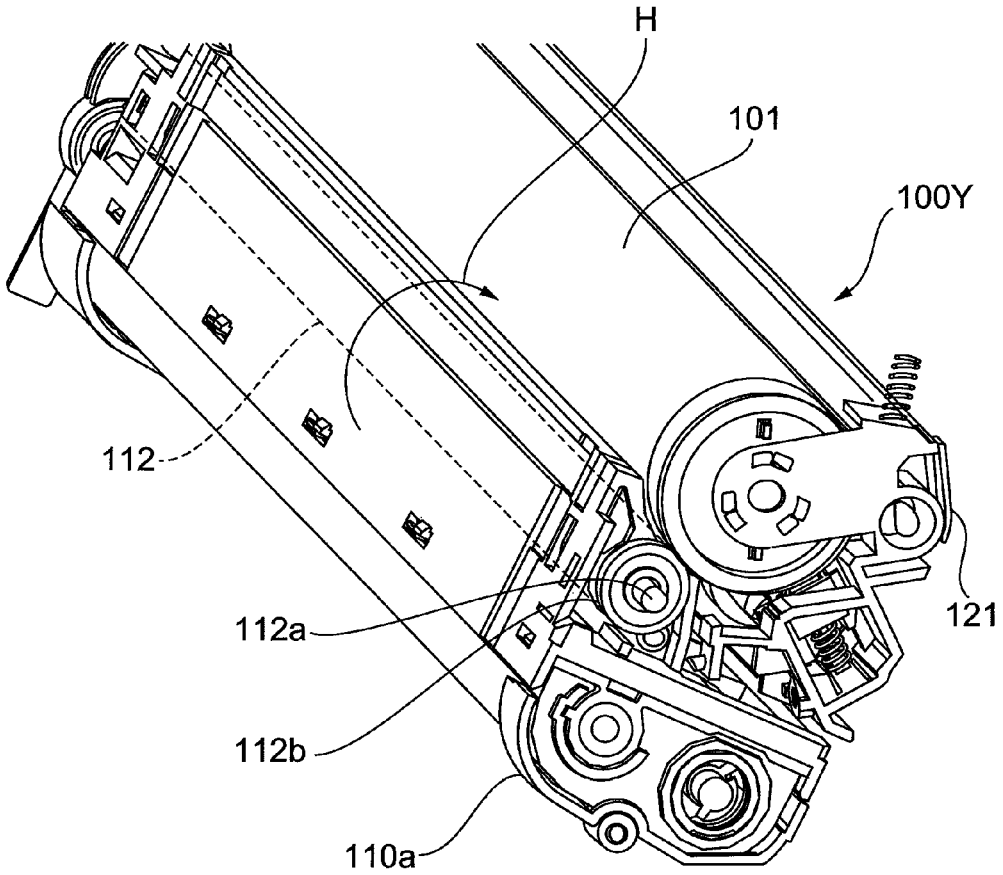
FIG. 15 is a diagram that illustrates the development roll urged toward the photoreceptor roll side.

FIG. 15 is a diagram that illustrates the development roll urged toward the photoreceptor roll side.

FIG. 15 illustrates the image forming unit 100Y, in a state in which a part of each of the photoreceptor-unit frame 121 and the developer-device frame 110*a* on the front-side standing wall 312 side is removed, so that the end of the development roll 112 on the front-side standing wall 312 side is visible.

The pulling spring 307 illustrated in FIG. 14 pulls up the shaft 112*a* of the development roll 112 toward the front-side standing wall 312, so that the development roll 112 is pressed against the photoreceptor roll 101 in a direction indicated by an arrow H in FIG. 14.

Here, provided at the end of the development roll 112*a*, on the front-side standing wall 312 side, is a tracking roll 112*b* that controls a space between the circumferential surface of the development roll 112 and the circumferential surface of the photoreceptor roll 101 to a constant space. The radius of this tracking roll 112*b* is longer than the radius of the development roll 112 only by a predetermined length. When the development roll 112 is pressed against the photoreceptor roll 101 by the pulling spring 307, the circumference of this tracking roll 112*b* contacts the circumferential surface of the photoreceptor roll 101. As a result, the space between the circumferential surface of the development roll 112 and the circumferential surface of the photoreceptor roll 101 is controlled to the space corresponding to the difference between the radius of the tracking roll 112*b* and the radius of the development roll 112.

Incidentally, with reference to FIG. 14 and FIG. 15, the structure related to the urging of the development roll 112 by the pulling spring 307 has been described for the image forming unit 100Y of yellow, but this structure also applies to the image forming units 100M, 100C and 100K of other colors.

As described above, in the color printer 1, the pulling spring 307 that urges the development roll 112 toward the photoreceptor roll 101 is disposed between the development roll 112 and the front-side standing wall 312, namely, outside of the image forming units 100Y, 100M, 100C and 100K.

Here, suppose a case in which the pulling spring is disposed inside the image forming unit is considered. In this case, in the inside of the image forming unit, not only a space for storing the pulling spring itself is required, but there is a possibility that a waste space may be formed around the pulling spring. In contrast, as for the color printer 1, the space for storing the pulling spring itself as well as the waste space around the pulling spring are eliminated in the image forming units 100Y, 100M, 100C and 100K and thus, the size is reduced.

[Drive Unit]

Next, the drive unit 400 illustrated in FIG. 5 will be described in detail.

As described earlier, the drive unit 400 is fixed to the drive-side standing wall 311 with the plural screws 401.

Figure 16:
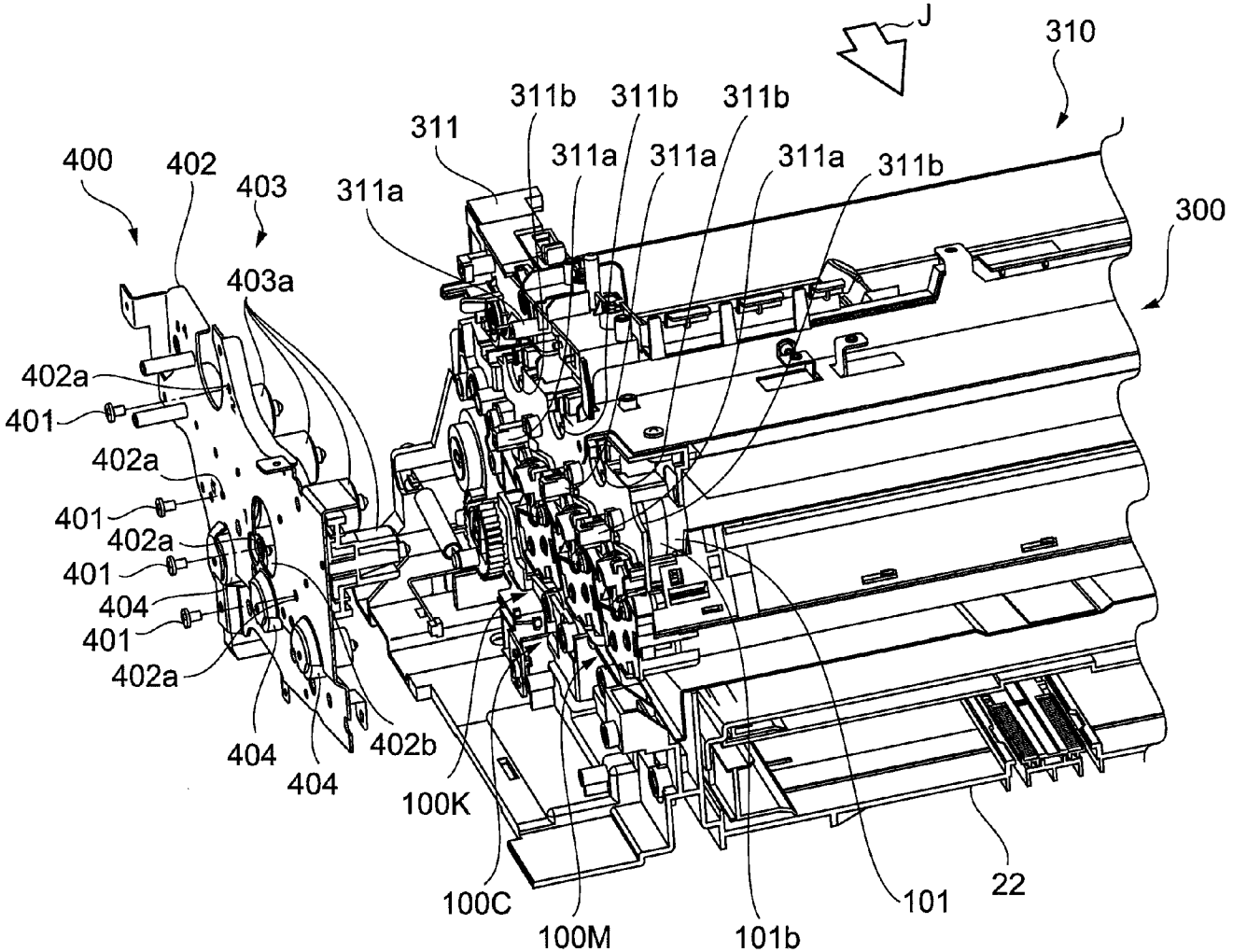
FIG. 16 is an exploded view that illustrates a state in which the drive unit is fixed to the base unit by the plural screws.

FIG. 16 is an exploded view that illustrates a state in which the drive unit is fixed to the base unit by the plural screws.

Incidentally, FIG. 16 is the exploded view of an internal structure of the color printer 1 illustrated in FIG. 4 and FIG. 6, with the drive unit 400 being placed at a position away from the drive-side standing wall 311. In this exploded view of FIG. 16, there is illustrated a state in which the base structure 22, the base unit 300 and the drive unit 400 are cut along a section that spreads between the image forming unit 100M of magenta and the image forming unit 100Y of yellow invisible in FIG. 16 and spreads along the photoreceptor roll 101.

As described earlier, the photoreceptor roll 101 incorporated into each of the image forming units 100Y, 100M, 100C and 100K has the photoreceptor-side gear 101*b* receiving the rotational driving force from the drive unit 400, on the side where the drive-side standing wall 311 is provided.

The drive unit 400 includes a drive-unit frame 402 that is a metallic support. In this drive-unit frame 402, a threaded hole 402*a* is formed at a position corresponding to each of the bosses 311*a* which are provided in the drive-side standing wall 311 and also illustrated in FIG. 6. The drive unit 400 is fixed to the drive-side standing wall 311, when the screw 401 after passing through each of the threaded holes 402*a* of this drive-unit frame 402 is inserted to engage in the internal thread of each of the bosses 311*a* of the drive-side standing wall 311.

Further, of the drive-unit frame 402, an internal surface facing the drive-side standing wall 311 supports a photoreceptor driving gear train 403 that transmits the rotational driving force from a motor not illustrated to the photoreceptor-side gear 101*b* of each of the photoreceptor rolls 101.

Here, in each of the image forming units 100Y, 100M, 100C and 100K, the developer device 110 illustrated in FIG. 2 has a not-illustrated gear that receives the rotational driving force and transmits the received rotational driving force to the development roll 112 and the stirring conveyance member 111*b*. Further, the drive-unit frame 402 supports: a developer-device driving gear train 404 that transmits a rotational driving force from a motor to the not-illustrated gear; and although not being illustrated, other elements such as a gear that meshes with and thereby transmits a rotational driving force from a motor to each gear of the photoreceptor driving gear train 403 and the developer-device driving gear train 404 in this drive unit 400.

Further, the drive-unit frame 402 is provided with one motor-rotation-driving force entrance port 402*b*, through which the not-illustrated gears for transmitting the rotational driving force from the motor to the gears supported by the drive-unit frame 402 enter toward the inner side of this drive-unit frame 402.

The drive unit 400 described above is equivalent to an example of the driving transmission section according to the present invention.

In the color printer 1, the photoreceptor driving gear train 403, the developer-device driving gear train 404, and the like are supported by the drive-unit frame 402, and thereby unitized as the drive unit 400. Further, this drive unit 400 is fixed to the drive-side standing wall 311 by the screws, so that all the plural gears supported by the drive-unit frame 402 mesh with the corresponding gears at the same time. Thus, this color printer 1 is readily assembled as compared to an image forming apparatus of a type in which plural gears of a gear train like those described above are individually installed to mesh with the corresponding gears.

The description of the drive unit 400 will be continued below by focusing attention on the photoreceptor driving gear train 403.

The photoreceptor driving gear train 403 has four driving gears 403*a* each of which is to mesh with the photoreceptor-side gear 101*b*. Incidentally, the photoreceptor driving gear train 403 also includes not-illustrated gears that are disposed between these four driving gears 403*a* and transmit the rotational driving force from a motor to each of the driving gears 403*a*.

When the drive unit 400 is fixed to the drive-side standing wall 311 as described above, each of the driving gears 403*a* enters the inside of the frame 310 from the gear access port 311*b* of the drive-side standing wall 311, and meshes with the photoreceptor-side gear 101*b* located inside the gear access port 311*b*.

Figure 17:
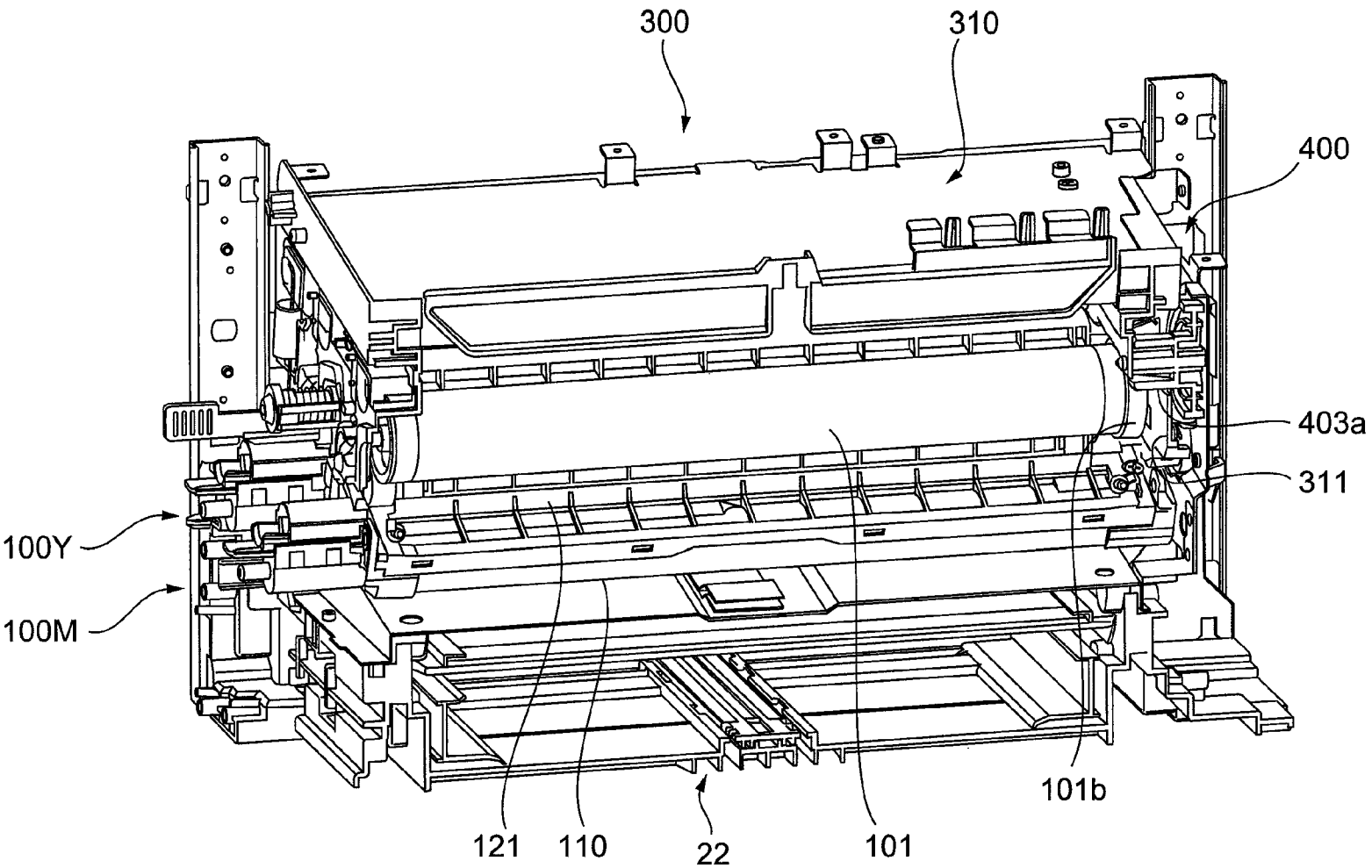
FIG. 17 is a diagram that illustrates a state in which the driving gears of the drive unit and the photoreceptor-side gears of the photoreceptor roll are in mesh.

FIG. 17 is a diagram that illustrates a state in which the driving gears of the drive unit and the photoreceptor-side gears 101*b* of the photoreceptor roll are in mesh.

FIG. 17 illustrates a perspective view of the base structure 22, the base unit 300 and the drive unit 400 in a state of being cut along a section that passes between the image forming unit 100M of magenta and the image forming unit 100C of cyan invisible in FIG. 17, and spreads along the photoreceptor roll 101. FIG. 17 illustrates the base structure 22, the base unit 300 and the drive unit 400 when viewed from a direction indicated by an arrow J in FIG. 16. For this reason, in reverse to FIG. 16, FIG. 17 illustrates the drive unit 400 on the right side in FIG. 17. Further, in FIG. 17, a part of each of the photoreceptor-unit frame 121 and the developer device 110 in the image forming unit 100M of magenta is removed, and there the photoreceptor roll 101 is exposed.

The driving gear 403*a* of the drive unit 400 fixed to the drive-side standing wall 311 meshes with the photoreceptor-side gear 101*b* of the photoreceptor roll 101, in the inside of the frame 310.

Figure 18:
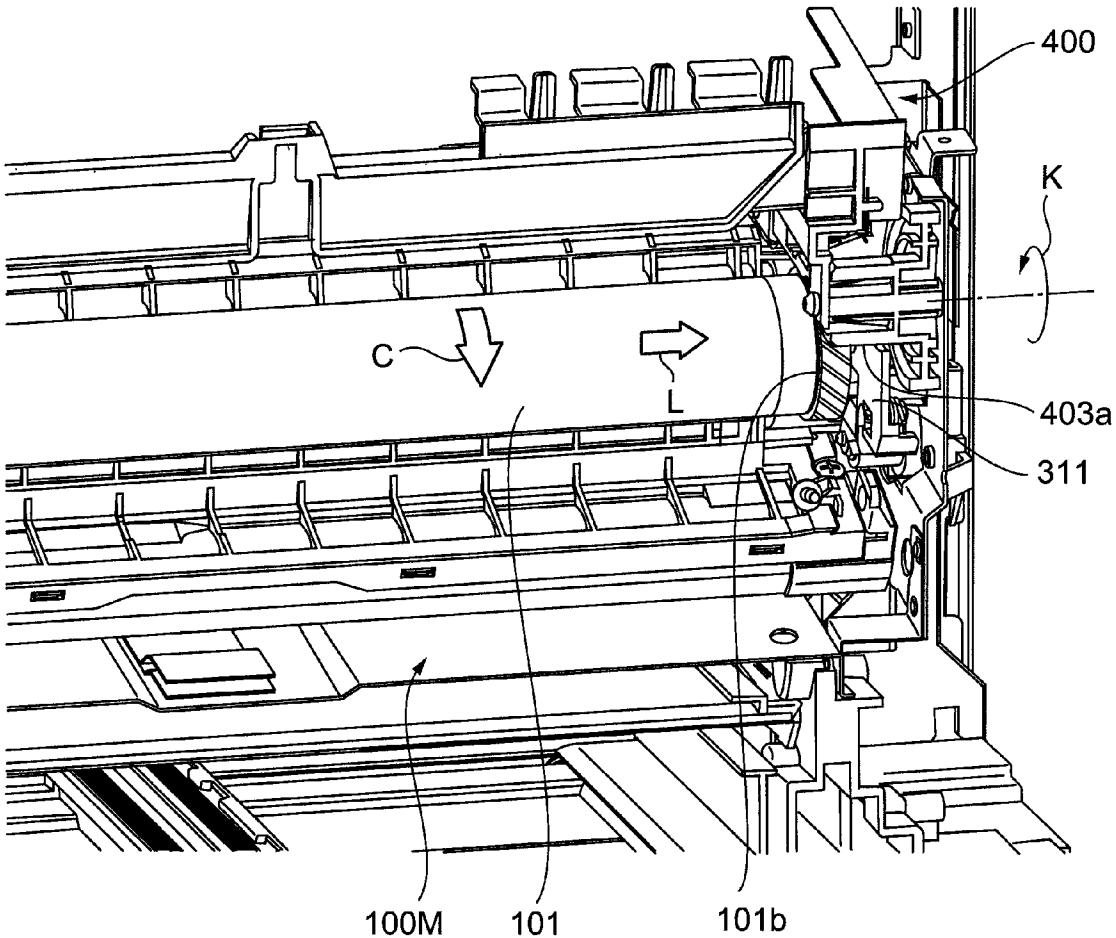
FIG. 18 is an enlarged view of a part where the driving gear and the photoreceptor-side gear 101*b* in FIG. 17 are in mesh.

FIG. 18 is an enlarged view of a part where the driving gear 403*a* and the photoreceptor-side gear 101*b* in FIG. 17 are in mesh.

The driving gear 403*a* rotates in a direction indicated by an arrow K by the rotational driving force from the not-illustrated motor. Further, by the rotation of this driving gear 403*a*, the photoreceptor-side gear 101*b* meshing with this driving gear 403*a* rotates in the direction indicated by the arrow C, which is also illustrated in FIG. 3, and also the photoreceptor roll 101 of the image forming unit 100M rotates in the direction indicated by the arrow C.

Here, the driving gear 403*a* and the photoreceptor-side gear 101*b* are formed to have helical teeth, thereby moving the photoreceptor roll 101 rotating as described above in a direction indicated by an arrow L in FIG. 18, namely, by pulling the photoreceptor roll 101 toward the drive-side standing wall 311. Further, as described earlier, the image forming unit 100M is fixed to the drive-side standing wall 311 by the screw. In other words, in this color printer 1, when the photoreceptor roll 101 is rotationally driven, the photoreceptor roll 101 is pulled toward the drive-side standing wall 311 on the side where the image forming unit 100M is fixed. As a result, while the photoreceptor roll 101 is rotationally driven, the image forming unit 100M fixed to the drive-side standing wall 311 by the screw is pressed against the drive-side standing wall 311. Contrary to such a structure, if a force to move the image forming unit 100M away from the drive-side standing wall 311 is caused between the driving gear 403*a* and the photoreceptor-side gear 101*b* during the rotational driving, there is a possibility that the screw 103 may become gradually loose in the rotational driving for a long time. In the color printer 1 of the present exemplary embodiment, as described above, during the rotational driving, the image forming unit 100M is pressed against the drive-side standing wall 311 and thus, the photoreceptor roll 101 is rotationally driven in a state in which the screw 103 is prevented from becoming loose.

Further, in this color printer 1, the rotational driving force is transmitted so that the driving gear 403*a* and the photoreceptor-side gear 101*b* approach each other. As a result, the width of mesh of the driving gear 403*a* and the photoreceptor-side gear 101*b* is widened so that the photoreceptor roll 101 rotates smoothly.

Incidentally, in FIG. 17 and FIG. 18, the structure related to the mesh between the driving gear 403*a* and the photoreceptor-side gear 101*b* has been described for the image forming unit 100M of magenta, but this structure also applies to the image forming units 100M, 100C and 100K of other colors. Further, here, the tooth shape of the gear of the developer-device driving gear train 404 and the tooth shape of the developer-device-side gear in mesh with the gear are not particularly specified. However, these gears also may be helical to pull the developer-device-side gear toward to the drive-side standing wall 311.

Furthermore, the color printer 1 has been taken as one exemplary embodiment of the image forming apparatus of the present invention, but the image forming apparatus of the present invention is not limited to this embodiment and may be, for example, a color copying machine, facsimile, or the like.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The exemplary embodiment is chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a frame that includes a pair of standing walls spaced apart from each other, and a linking section linking the pair of standing walls with each other;

an intermediate transfer section that includes a plurality of support rolls extending between the pair of standing walls and being supported by the pair of standing walls, and an intermediate transfer belt held by the plurality of support rolls and circulating; and a plurality of built-in bodies, at least, into each of which a photoreceptor roll having a shaft with protruding both ends and rotatable around the shaft is incorporated, and which are arranged along the intermediate transfer belt while being supported in a state that the both ends of the shaft penetrate the pair of standing walls, and each of which is fixed to a first standing wall of the pair of standing walls, wherein each of the plurality of built-in bodies incorporates a developer device which has a development roll extending between the pair of standing walls along the photoreceptor roll and developing a latent image formed on the photoreceptor roll with a toner, wherein the image forming apparatus further includes an urging spring which is arranged between the developer device and the pair of standing walls and urges the developing roll toward a side of the photoreceptor roll.

2. The image forming apparatus according to claim 1, wherein in the frame, the pair of standing walls are made of resin, and the linking section is a metallic plate.

3. The image forming apparatus according to claim 1, wherein the photoreceptor roll incorporated into each of the built-in bodies includes a gear being provided on a first-standing-wall side and receiving a rotational driving force, and the image forming apparatus further comprises a driving transmission section that includes a support and a gear train being supported by the support and transferring the rotational driving force to a plurality of the gears incorporated into the plurality of built-in bodies, and is fixed to the first standing wall.

4. The image forming apparatus according to claim 3, wherein the gear of the photoreceptor roll and a gear to mesh with the gear are formed to be helical to pull the photoreceptor roll toward a side where the first standing wall is provided.

5. The image forming apparatus according to claim 2, wherein on a side opposite to the built-in body, a power supply unit is disposed across the linking section interposed in between.

6. The image forming apparatus according to claim 1, wherein an exposure device that exposes the photoreceptor roll is fixed to the built-in body.

* * * * *